US009308740B2

(12) United States Patent
Mitsuzawa

(10) Patent No.: US 9,308,740 B2
(45) Date of Patent: Apr. 12, 2016

(54) PRINTING METHOD AND PRINTING APPARATUS

(71) Applicant: Seiko Epson Corporation, Tokyo (JP)
(72) Inventor: Toyohiko Mitsuzawa, Shiojiri (JP)
(73) Assignee: Seiko Epson Corporation, Tokyo (JP)

( * ) Notice: Subject to any disclaimer, the term of this patent is extended or adjusted under 35 U.S.C. 154(b) by 0 days.
(21) Appl. No.: 14/306,155
(22) Filed: Jun. 16, 2014
(65) Prior Publication Data
US 2014/0292929 A1 Oct. 2, 2014

Related U.S. Application Data
(63) Continuation of application No. 13/586,779, filed on Aug. 15, 2012, now Pat. No. 8,789,916, which is a continuation of application No. 12/699,268, filed on Feb. 3, 2010, now Pat. No. 8,267,507.
(30) Foreign Application Priority Data
Feb. 4, 2009 (JP) ..... 2009-024186
(51) Int. Cl.
*B41J 2/015* (2006.01)
*B41J 2/01* (2006.01)
*B41J 2/21* (2006.01)
*B41J 11/00* (2006.01)
(Continued)
(52) U.S. Cl.
CPC ..... *B41J 2/211* (2013.01); *B41J 2/2114* (2013.01); *B41J 11/002* (2013.01); *B41J 29/38* (2013.01); *B41M 7/0081* (2013.01); *B41J 2/2107* (2013.01)
(58) Field of Classification Search
None
See application file for complete search history.

(56) References Cited
U.S. PATENT DOCUMENTS
5,579,693 A 12/1996 Carreira et al.
6,167,231 A 12/2000 Blackman et al.
(Continued)
FOREIGN PATENT DOCUMENTS
JP 2000-158793 A 6/2000
JP 2003-191594 A 7/2003
(Continued)
OTHER PUBLICATIONS
Non-Final Office Action, dated Dec. 20, 2011, of related U.S. Appl. No. 12/699,268.
(Continued)

*Primary Examiner* — Julian Huffman
*Assistant Examiner* — Leonard S Liang
(74) *Attorney, Agent, or Firm* — Kilpatrick Townsend & Stockton LLP

(57) ABSTRACT

There is provided a printing method that is performed by using a first nozzle ejecting color ink that is used for printing an image on a medium, a second nozzle ejecting a process solution that is used for processing the surface of the medium. The printing method includes printing an image constituted by color dots on the medium by ejecting the color ink from the first nozzle so as to form the color dots on the medium and forming process dots in areas other than the image on the medium by ejecting the process solution from the second nozzle, transporting the medium in a direction opposite to a transport direction after the color dots and the process dots are formed on the medium, and coating the color dots and the process dots with the process solution after the medium is transported in the direction opposite to the transport direction.

12 Claims, 11 Drawing Sheets

(51) Int. Cl.
*B41J 29/38* (2006.01)
*B41M 7/00* (2006.01)

(56) References Cited

U.S. PATENT DOCUMENTS

| | | | | |
|---|---|---|---|---|
| 6,352,255 | B1 | 3/2002 | Taylor | |
| 6,428,157 | B1 | 8/2002 | Wen | |
| 6,619,792 | B1 | 9/2003 | Roberts et al. | |
| 6,648,446 | B1 | 11/2003 | Rutland et al. | |
| 6,655,797 | B2 | 12/2003 | Smith et al. | |
| 7,044,593 | B2 | 5/2006 | Onishi | |
| 7,108,368 | B2 | 9/2006 | Saito et al. | |
| 7,178,898 | B2 | 2/2007 | Hoshino | |
| 7,318,637 | B2 | 1/2008 | Ishimoto et al. | |
| 7,422,297 | B2 | 9/2008 | Nakamura | |
| 7,508,544 | B2 * | 3/2009 | Kakutani | 358/1.9 |
| 7,549,740 | B2 | 6/2009 | Yokoyama et al. | |
| 7,651,215 | B2 | 1/2010 | Hoshino | |
| 8,079,694 | B2 | 12/2011 | Steed et al. | |
| 2003/0222928 | A1 | 12/2003 | Cummins et al. | |
| 2004/0070657 | A1 | 4/2004 | Roberts et al. | |
| 2004/0104987 | A1 | 6/2004 | Smith et al. | |
| 2005/0141942 | A1 * | 6/2005 | Someno | 400/76 |
| 2005/0179709 | A1 | 8/2005 | Salisbury et al. | |
| 2005/0190248 | A1 | 9/2005 | Konno et al. | |
| 2006/0227194 | A1 | 10/2006 | Hoshino | |
| 2007/0013759 | A1 | 1/2007 | Kadomatsu et al. | |
| 2007/0024686 | A1 | 2/2007 | Kadomatsu et al. | |
| 2007/0040885 | A1 * | 2/2007 | Kusunoki | 347/102 |
| 2007/0109341 | A1 | 5/2007 | Niioka | |
| 2007/0188575 | A1 * | 8/2007 | Nakazawa | 347/102 |
| 2007/0202454 | A1 | 8/2007 | Mersmann et al. | |
| 2007/0211100 | A1 * | 9/2007 | Mizutani et al. | 347/19 |
| 2010/0149231 | A1 | 6/2010 | Mori et al. | |
| 2010/0165021 | A1 * | 7/2010 | Mitsuzawa | 347/9 |
| 2010/0201771 | A1 | 8/2010 | Mitsuzawa | |

FOREIGN PATENT DOCUMENTS

| | | | |
|---|---|---|---|
| JP | 2004-188926 | A | 7/2004 |
| JP | 2004-330569 | A | 11/2004 |
| JP | 2005/059462 | A2 | 6/2005 |
| JP | 2005-199563 | A | 7/2005 |
| JP | 2006-076122 | A | 3/2006 |
| JP | 2007-204581 | A | 8/2007 |
| JP | 2007-210169 | A | 8/2007 |

OTHER PUBLICATIONS

Notice of Allowance, dated May 15, 2012, of related U.S. Appl. No. 12/699,268.

Non-Final Office Action, dated Aug. 15, 2013, of related U.S. Appl. No. 13/586,779.

Notice of Allowance, dated Mar. 14, 2014, of related U.S. Appl. No. 13/586,779.

* cited by examiner

PRINTING METHOD AND PRINTING APPARATUS

This application is a continuation of U.S. patent application Ser. No. 13/586,779 filed Aug. 15, 2012, which is a continuation of U.S. patent application Ser. No. 12/699,268, filed Feb. 3, 2010, which claims benefit of Japanese Patent Application No. 2009-024186, filed Feb. 4, 2009, the entireties of which are incorporated by reference herein.

BACKGROUND

1. Technical Field

The present invention relates to a printing method and a printing apparatus.

2. Related Art

Printing apparatuses that perform printing by using ink (for example, UV ink) that is cured by receiving irradiation of an electromagnetic wave (for example, an ultraviolet ray (UV)) are known. In such printing apparatuses, ink is ejected onto a medium (a paper sheet, a film, or the like) from a nozzle, and then an electromagnetic wave is emitted onto dots formed on the medium. Accordingly, the dots are cured so as to be fixed to the medium. Thus, excellent printing can be performed even for a medium that cannot easily absorb liquid (for example, see JP-A-2000-158793).

When an image is printed by using UV ink, gloss is different between an area in which an image is printed and an area in which an image is not printed. Thus, a method in which the entire surface of the medium is coated with colorless transparent UV clear ink (one type of a process solution) so as to acquire uniform gloss of the surface of the medium may be considered.

However, only by coating the entire surface with a process solution such as clear ink after an image is formed by using color ink, the clear ink is aggregated in the areas in which the image is not printed, whereby the gloss may be not uniform.

SUMMARY

An advantage of some aspects of the invention is that it provides a printing method and a printing apparatus capable of suppressing degradation of the image quality due to aggregation of ink.

According to a first aspect of the invention, there is provided a printing method that is performed by using a first nozzle ejecting color ink that is used for printing an image on a medium and is cured in a case where irradiation of an electromagnetic wave is received, a second nozzle ejecting a process solution that is used for processing the surface of the medium and is cured in a case where irradiation of an electromagnetic wave is received, and an irradiation unit emitting the electromagnetic wave. The printing method includes: printing an image constituted by color dots on the medium by ejecting the color ink from the first nozzle so as to form the color dots on the medium and forming process dots in areas other than the image on the medium by ejecting the process solution from the second nozzle; emitting the electromagnetic wave onto the color dots and the process dots; coating the color dots and the process dots with the process solution after the electromagnetic wave is emitted onto the color dots and the process dots; and emitting the electromagnetic wave onto the process solution with which the color dots and the process dots are coated.

According to the above-described printing method, the process dots are formed in areas other than an image area.

Accordingly, degradation of the image quality due to aggregation of the process solution can be suppressed.

The above-described printing method may further include: emitting the electromagnetic wave from the irradiation unit onto the color dots and the process dots before the color dots and the process dots are in contact with each other. In the case, in the printing of an image on the medium and the forming of process dots, the color dots and the process dots are not in contact with each other.

In such a case, degradation of the image quality due to permeation of ink between the color dots and the process dots can be suppressed.

In the above-described printing method, it may be configured that the electromagnetic wave is emitted onto the color dots and the process dots with the amount of irradiation that allows the diameters of the color dots and the process dots to expand before the color dots and the process dots formed on the medium are in contact with each other, and, after the color dots and the process dots are into contact with each other due to expansion of the diameters of the color dots and the process dots after irradiation of the electromagnetic wave, the electromagnetic wave is further emitted onto the color dots and the process dots.

In such a case, after the color dots and the process dots are expanded, the dots are solidified. Accordingly, a gap between the color dot and the process dot decreases, whereby more uniform gloss can be acquired.

In the above-described printing method, the areas may be determined in accordance with one of a time interval from the formation of the color dots to the irradiation of the electromagnetic wave from the irradiation unit and a time interval from the formation of the process dots to the irradiation of the electromagnetic wave from the irradiation unit.

In such a case, the color dots and the process dots are not in contact with each other when the electromagnetic wave is emitted.

In the above-described printing method, it may be configured that a third nozzle, which ejects the process solution, other than the second nozzle is disposed, another irradiation unit other than the irradiation unit is disposed on the downstream side in the transport direction of the medium relative to the third nozzle, the color dots and the process dots are coated with the process solution by the third nozzle, and the electromagnetic wave is emitted onto the process solution, with which the color dots and the process dots are coated, by the another irradiation unit.

In such a case, formation of color dots, formation of process dots, irradiation of the electromagnetic wave before the color dots and the process dots are in contact with each other, coating the color dots and the process dots with a process solution, and irradiation of the electromagnetic wave onto the coating process solution can be sequentially performed in accordance with transport of the medium in the transport direction.

In the above-described printing method, it may be configured that the first nozzles are aligned with a predetermined nozzle pitch, and the third nozzles are aligned with a predetermined nozzle pitch that is narrower than the predetermined nozzle pitch of the first nozzles.

In such a case, the dots can be formed with high density when coating with the process solution is performed. Thus, even in a case where there is unevenness on the surface of the medium more or less, a uniform surface can be acquired.

According to a second aspect of the invention, there is provide a printing apparatus including: a first nozzle ejecting color ink that is used for printing an image on a medium and is cured in a case where irradiation of an electromagnetic wave is received; a second nozzle ejecting a process solution that is used for processing the surface of the medium and is cured in a case where irradiation of an electromagnetic wave is received; an irradiation unit emitting the electromagnetic wave; and a controller that prints an image constituted by color dots on the medium by ejecting the color ink from the first nozzle so as to form the color dots on the medium, forms process dots in areas other than the image on the medium by ejecting the process solution from the second nozzle; emits the electromagnetic wave onto the color dots and the process dots by using the irradiation unit; then coats the color dots and the process dots with the process solution; and emits the electromagnetic wave onto the process solution, with which the color dots and the process dots are coated, by using the irradiation unit.

According to a third aspect of the invention, there is provided a printing method that is performed by using a first nozzle ejecting color ink that is used for printing an image on a medium and is cured in a case where irradiation of an electromagnetic wave is received, a second nozzle ejecting background ink that is used for printing a background of the image and is cured in a case where irradiation of an electromagnetic wave is received, a third nozzle ejecting a process solution that is used for processing the surface of the medium and is cured in a case where irradiation of an electromagnetic wave is received, and an irradiation unit emitting the electromagnetic wave. The printing method includes: printing an image constituted by color dots on the medium by ejecting the color ink from the first nozzle so as to form the color dots on the medium and forming background dots in areas other than the image on the medium by ejecting the background solution from the second nozzle; emitting the electromagnetic wave onto the color dots and the background dots; coating the color dots and the background dots with the process solution after the electromagnetic wave is emitted onto the color dots and the background dots; and emitting the electromagnetic wave onto the process solution with which the color dots and the background dots are coated.

According to the above-described printing method, background dots are formed in areas other than the image area. Accordingly, degradation of the image quality due to aggregation of the process solution can be suppressed.

Other aspects of the invention will become apparent by referring to description as below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a line printer (printer 1) as an example of a printing apparatus according to a first embodiment of the invention will be described.

Configuration of Printer

Figure 1:
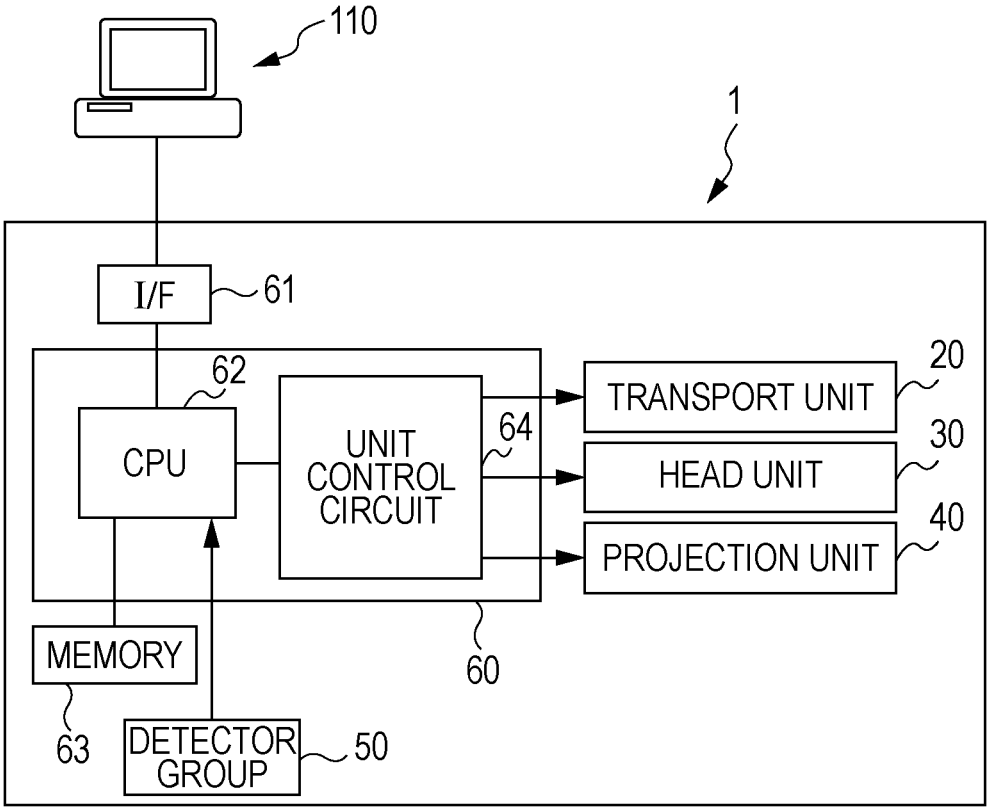
FIG. 1 is a block diagram showing the configuration of a printer.
Figure 2:
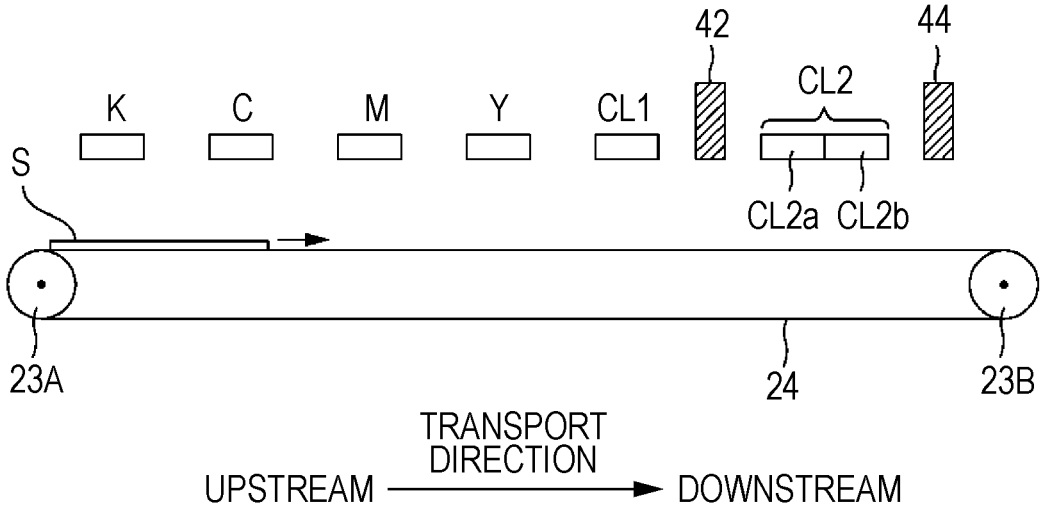
FIG. 2 is a schematic diagram of the periphery of a print area.

FIG. 1 is a block diagram showing the entire configuration of the printer 1. FIG. 2 is a schematic diagram of the periphery of a print area.

The printer 1 is a printing apparatus that prints an image on a medium such as a paper sheet, a cloth, or a film and is connected to a computer 110 as an external apparatus so as to communicate with each other.

In the computer 110, a printer driver is installed. The printer driver is a program that is used for converting image data output from an application program into print data by displaying a user interface in a display device (not shown). This printer driver is recorded on a recording medium (computer-readable recording medium) such as a flexible disk FD or a CD-ROM. Alternatively, the printer driver may be downloaded into the computer 110 through the Internet. This program is configured by codes for implementing various functions.

The computer 110 outputs print data corresponding to a print image to the printer 1 for printing an image by using the printer 1.

Here, a "printing apparatus" represents an apparatus that prints an image on a medium. For example, the printer 1 corresponds to the printing apparatus. In addition, a "printing control apparatus" represents an apparatus that controls the printing apparatus. For example, the computer 110 to which a printer driver is installed corresponds to the printing control apparatus.

The printer 1 of this embodiment is an apparatus that prints an image on a medium by ejecting ultraviolet-curable ink (hereinafter, referred to as UV ink) that is cured by receiving irradiation of an ultraviolet ray (hereinafter, referred to as UV) as an example of liquid thereon. The UV ink is ink that contains ultraviolet-curable resin. When the UV is emitted onto the UV ink, the UV ink is cured due to a photopolymerization reaction in an ultraviolet-curable resin. The printer 1 of this embodiment prints an image by using UV ink of four colors of CMYK (color ink) and colorless transparent UV ink (clear ink).

The printer 1 of this embodiment includes a transport unit 20, a head unit 30, an irradiation unit 40, a detector group 50, and a controller 60. When receiving print data from the computer 110 as an external apparatus, the printer 1 prints an image on a medium based on the print data by controlling each unit (the transport unit 20, the head unit 30, and the irradiation unit 40) by using the controller 60. The controller 60 prints an image on a medium by controlling each unit based on the print data received from the computer 110. The status of the inside of the printer 1 is monitored by the detector group 50, and the detector group 50 outputs the result of detection to the controller 60. Then, the controller 60 controls each unit based on the result of detection that is output from the detector group 50.

The transport unit 20 is used for transporting a medium (for example, a paper sheet S or the like) in a predetermined direction (hereinafter, referred to as a transport direction). This transport unit 20 includes an upstream transport roller 23A, a downstream transport roller 23B, and a belt 24. When a transport motor not shown in the figure rotates, the upstream transport roller 23A and the downstream transport roller 23B rotate, whereby the belt 24 is rotated. A medium that is fed by a feed roller (not shown) is transported to a printable area (an area facing a head) by the belt 24. As the belt 24 transports the medium, the medium moves in the transport direction with respect to the head unit 30. The medium that passes through the printable area is discharged to the outside by the belt 24. The medium in the middle of the transport process is electrostatically-adsorbed or vacuum-adsorbed to the belt 24.

The head unit 30 is used for ejecting the UV ink on a medium. In this embodiment, as the UV ink, color ink for forming an image by using the UV ink and colorless transparent clear ink are ejected. The head unit 30 forms dots on a medium by ejecting ink on the medium in the middle of the transport process, thereby an image is printed on the medium. The printer 1 of this embodiment is a line printer, and each head of the head unit 30 can form dots corresponding to a width of the medium once. As shown in FIG. 2, sequentially from the upstream side in the transport direction, a black ink head K ejecting black UV ink, a cyan ink head C ejecting cyan UV ink, a magenta ink head M ejecting magenta UV ink, a yellow ink head Y ejecting yellow UV ink, and first and second clear ink heads CL1 and CL2 ejecting clear ink are disposed. In addition, the head of each color that ejects color ink is also referred to as a head for color ink, and each head that ejects clear ink is also referred to as a head for clear ink. In addition, of the heads for clear ink, the first clear ink head CL1 is also simply referred to as a first head CL1, and the second clear ink head CL2 is also simply referred to as a second head CL2.

The configuration of the head unit 30 will be described later in detail.

The irradiation unit 40 emits the UV toward the UV ink landed on a medium. A dot formed on a medium is cured by receiving UV irradiation from the irradiation unit 40. The irradiation unit 40 of this embodiment includes a provisional-curing irradiation section 42 and a main-curing irradiation section 44.

The provisional-curing irradiation section 42 emits the UV for curing the dot formed on the medium. In this embodiment, provisional curing is performed by preventing permeation between dots.

The provisional-curing irradiation section 42 is disposed between the first head CL1 and the second head CL2 as the heads for clear ink. In addition, the length of the provisional-curing irradiation section 42 in the medium-width direction is equal to or more than the medium width. Then, the provisional-curing irradiation section 42 emits the UV onto dots that are formed by the heads for color ink and the first head CL1 of the head unit 30.

The provisional-curing irradiation section 42 includes a light emitting diode (LED) as a light source of the UV irradiation. The LED can change the irradiation energy in an easy manner by controlling the magnitude of the input current.

The provisional curing will be described in detail later.

The main-curing irradiation section 44 emits the UV for curing the dot formed on the medium. In this embodiment, main-curing is curing that is performed for completely solidifying the dot.

The main-curing irradiation section 44 is disposed on the downstream side in the transport direction relative to the second head CL2. The length of the main-curing irradiation section 44 is equal to or more than the medium width. Then, the main-curing irradiation section 44 emits the UV onto a dot formed by each head of the head unit 30.

The main-curing irradiation section 44 of this embodiment includes a lamp (metal halide lamp, a mercury lamp, or the like) as a light source of UV irradiation.

The main-curing will be described later in detail.

The detector group 50 includes a rotary encoder (not shown), a paper detecting sensor (not shown), and the like. The rotary encoder detects the amount of rotation of the upstream transport roller 23A or the downstream transport roller 23B. The transport amount of a medium can be detected based on the result of detection performed by the rotary encoder. The paper detecting sensor detects the position of the front end of the medium that is in the middle of the feed process.

The controller 60 is a control unit for controlling the printer. The controller 60 includes an interface unit 61, a CPU 62, a memory 63, and a unit control circuit 64. The interface unit 61 performs data transmission and data reception between the computer 110 as an external apparatus and the printer 1. The CPU 62 is an arithmetic processing device for controlling the entire printer. The memory 63 is for acquiring an area in which a program of the CPU 62 is stored, a work area, or the like. The memory 63 includes a memory element such as a RAM or an EEPROM. The CPU 62 controls each unit through a unit control circuit 64 in accordance with the program stored in the memory 63.

Printing Operation

When the printer 1 receives print data from the computer 110, the controller 60, first, rotates the feed roller (not shown) by using the transport unit 20 so as to transfer a medium to be printed on the belt 24. The medium is transported at a constant speed on the belt 24 without being stopped and passes below the head unit 30 and the irradiation unit 40. During the transport of the medium, dots are formed on the medium by intermittently ejecting ink from nozzles of each head of the head unit 30, and the UV is emitted from each irradiation section of the irradiation unit 40. Accordingly, an image is printed on the medium. Finally, the controller 60 discharges the medium for which printing of an image has been completed.

Configuration of Head

As shown in FIG. 2, the printer 1 according to this embodiment includes heads for color ink and heads for clear ink.

The heads for color ink eject the UV ink, which is used for printing an image, for each ink color. In this embodiment, as the heads for color ink, sequentially from the upstream side in the transport direction, the black ink head K, the cyan ink head C, the magenta ink head M, and the yellow ink head Y are disposed. The heads for color ink are disposed on the upstream side in the transport direction relative to the heads for clear ink and the irradiation sections. The arrangement of nozzles of the heads for color ink will be described later.

The first head CL1 for clear ink ejects colorless transparent clear ink as one type of a process solution for processing the surface of the medium. In this embodiment, the first head CL1 ejects clear ink in areas other than an image area. The first head CL1 is disposed between the heads for color ink and the provisional-curing irradiation section 42. The arrangement of nozzles of the first head CL1 will be described later.

The second head CL2 for clear ink ejects (hereinafter, also referred to as coating) clear ink on the entire surface of a medium. The second head CL2 is disposed between the provisional-curing irradiation section 42 and the main-curing irradiation section 44. The arrangement of nozzles of the second head CL2 will be described later.

Figure 3A:
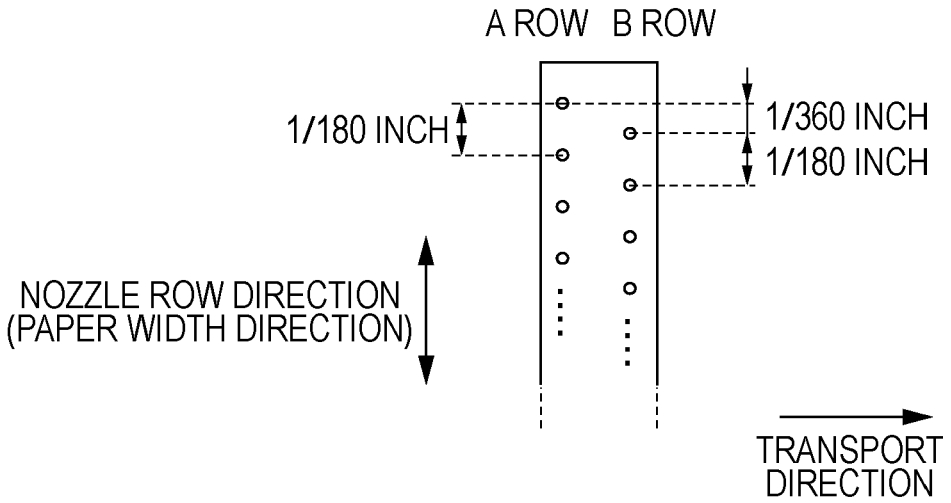
FIGS. 3A and 3B are explanatory diagrams illustrating the nozzle arrangement of each head.
Figure 3B:
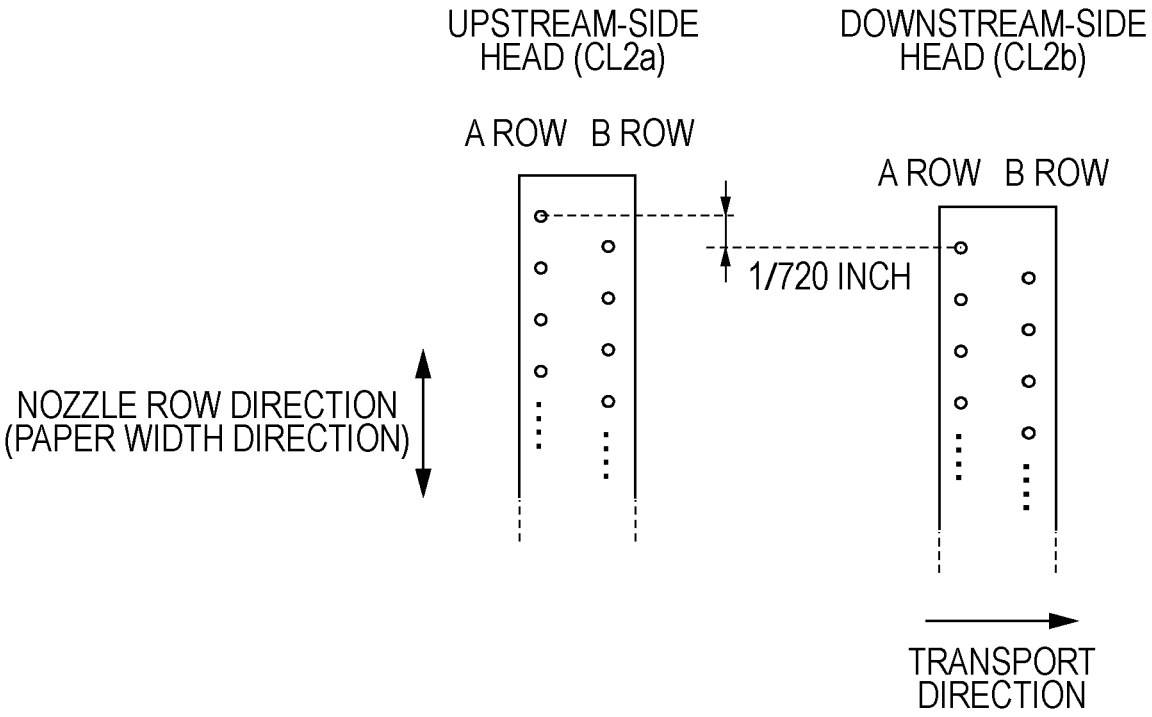

FIGS. 3A and 3B are explanatory diagrams illustrating the nozzle arrangement of each head.

FIG. 3A shows the nozzle arrangement of the head for color ink or the first head CL1 of the heads for clear ink. Each head, as shown in the figure, has two nozzle rows of "A row" and "B row".

The nozzles of each row are aligned at the interval (nozzle pitch) of 1/180 inches along a direction (direction of the nozzle row) intersecting with the transport direction. In addition, the position of the nozzles of the A row in the direction of the nozzle row and the position of nozzles of the B row in the direction of the nozzle row are deviated by a half nozzle pitch (1/360 inches). Accordingly, color dots or clear dots can be formed at the resolution of 1/360 inches.

FIG. 3B shows the arrangement of nozzles of the second head CL2 for clear ink. The second head CL2 includes an upstream head CL2*a* and a downstream head CL2*b*. The upstream head CL2*a* and the downstream head CL2*b*, similarly to the above-described heads for color ink or the first head CL1 of the heads for clear ink, has two nozzle rows of the "A row" and the "B row".

In the second head CL2, the position of the nozzle of the upstream head CL2*a* in the direction of the nozzle row and the position of the nozzle of the downstream head CL2*b* in the direction of the nozzle row is deviated by a ¼ nozzle pitch (1/720 inches). Accordingly, the second clear dots can be formed with the resolution of 1/720 inches. As described above, the number of nozzle rows of the second head CL2 is twice that of each head for color ink or the first head CL1 for clear ink, and accordingly, dots can be formed with high density.

In addition, the length of each nozzle row in the direction of the nozzle row is equal to or more than the medium width. Accordingly, dots corresponding to the medium width can be formed once.

Provisional Curing and Main Curing

Figure 4A:
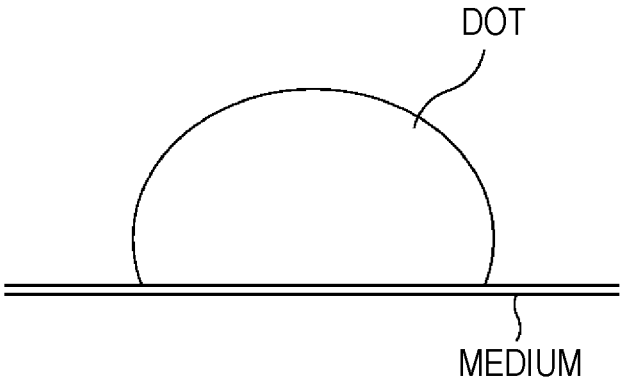
FIGS. 4A to 4C are diagrams illustrating the shapes of UV ink (dots) landed on a medium and irradiation timings of the UV.
Figure 4B:
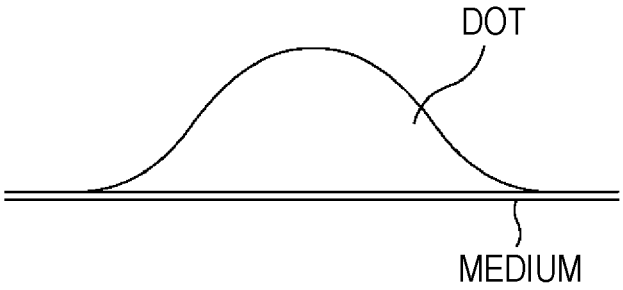
Figure 4C:
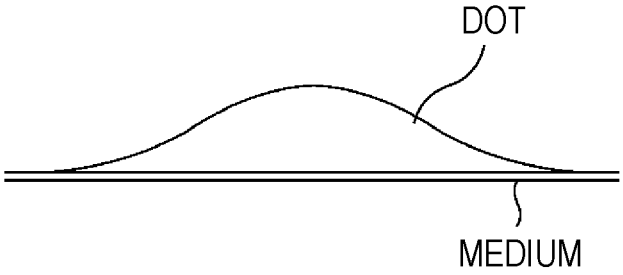

FIGS. 4A to 4C are diagrams illustrating the shapes of the UV ink (dots) landed on the medium and the irradiation timings of the UV. Here, in the order of FIGS. 4A, 4B, and 4C, the irradiation timings are sequentially delayed.

When the UV is emitted so as to stop expansion of a dot right after formation of the dot, the shape of the dot is, for example, as shown in FIG. 4A. In such a case, permeation can be suppressed. However, the unevenness of the medium surface that is configured by a dot increases, and accordingly, the gloss is degraded.

On the other hand, when the UV is emitted for the first time after the dot sufficiently spreads, the shape of the dot, for example, is as shown in FIG. 4C. In such a case, excellent gloss is acquired. However, permeation between dots of ink can occur easily.

In the printer 1 of this embodiment, as the irradiation unit 40, the provisional-curing irradiation section 42 and the main-curing irradiation section 44 are included. Thus, after a dot is formed, two steps of curing processes including a provisional curing process and a main curing process are performed. Hereinafter, the function of each curing process will be described.

The function of the provisional curing process is to prevent permeation between dots. The amount of irradiation of the UV that is emitted in the first provisional curing process is small. Accordingly, the UV ink (dot) is not completely solidified and continues to spread even after the first provisional curing process is performed. However, after the provisional curing process is performed, the problem of permeation cannot easily occur even when dots are brought into contact with each other.

On the other hand, the function of the main curing process is to completely solidify the ink. The amount of UV irradiation in the main curing process is greater than that in the provisional curing process. In other words, the condition of "UV irradiation amount in the provisional curing process<UV irradiation amount in the main curing process" is satisfied.

PROBLEM IN COMPARATIVE EXAMPLES AND BRIEF DESCRIPTION OF THIS EMBODIMENT

First Comparative Example

Figure 5:
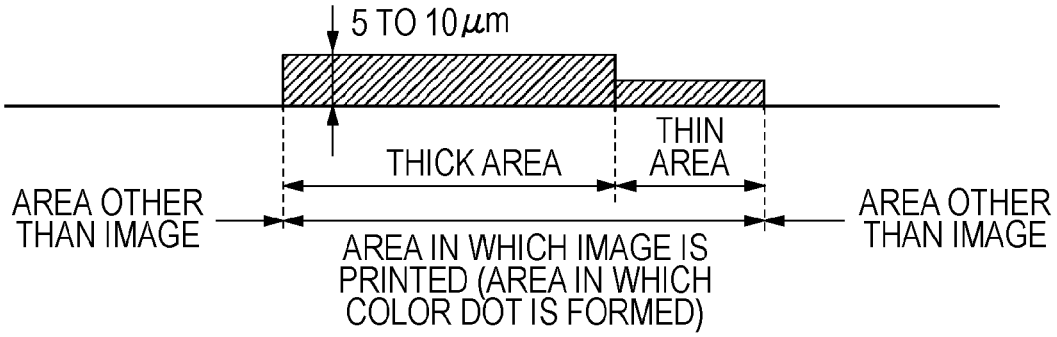
FIG. 5 is an explanatory diagram showing a case where printing is performed by only using color ink (first comparative example).

FIG. 5 is an explanatory diagram showing a case where printing is performed only by using color ink. In the descriptions below, a dot formed by color ink of each color is also referred to as a color dot.

In a case where UV ink is used, compared to a case where dots are formed by using ordinary water-based ink, the unevenness of the surface due to dots is large (for example, there is unevenness of about 5 to 10 μm as a difference in the height). On the other hand, in a case where ordinary water-based ink is used, the unevenness of a paper sheet is larger than the unevenness of dots, whereby the unevenness of the surface due to the dots does not stand out. In contrast, in a case where the UV ink is used, when printing is performed by only using color ink, the unevenness of gloss occurs, whereby the image quality is degraded (referred to as Problem 1). Thus, a countermeasure in which dots (hereinafter, referred to as clear dots) are formed in an area (area other than the image area) in which a color dot is not formed by using clear ink may be considered for the problem 1.

In addition, since the shading of an image is represented by a change in the density of dots, unevenness of the surface varies in accordance with the shading of the image (referred to as Problem 2). In FIG. 5, a thicker portion represents a dark portion of an image, and a thinner portion represents a light portion of the image. Relating to Problem 2, a countermeasure in which the entire surface is coated with clear ink after formation of an image may be considered.

Second Comparative Example

A second comparative example is a comparative example responding to the above-described Problem 1.

Figure 6:
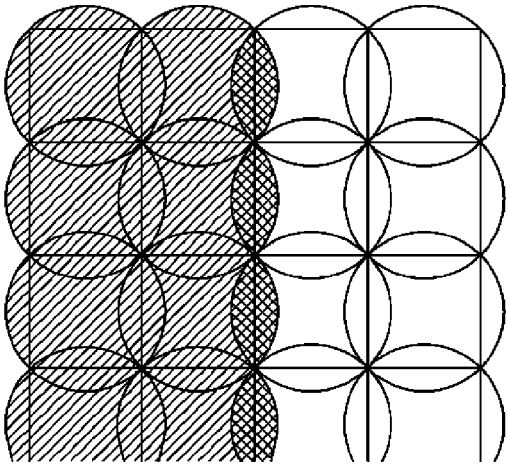
FIG. 6 is a schematic diagram showing a case where clear dots are formed in pixels that do not form a color dot (second comparative example).

FIG. 6 is a schematic diagram showing a case where clear dots are formed in pixels that do not form a color dot. In the figure, square boxes represent pixels on a medium. In addition, circles represent dots. A hatching dot represents a color dot, and an non-hatching dot represents a clear dot.

Generally, as shown in FIG. 6, a dot is formed to be larger than a pixel on a medium. The reason is for printing a filled-up image with no space therebetween. In this comparative example, in pixels that do not form color dots, clear dots are formed.

However, in such a case, in a black filled-up portion in the figure, a problem of permeation occurs (referred to as Problem 3).

Brief Description 1 of this Embodiment

Figure 7:
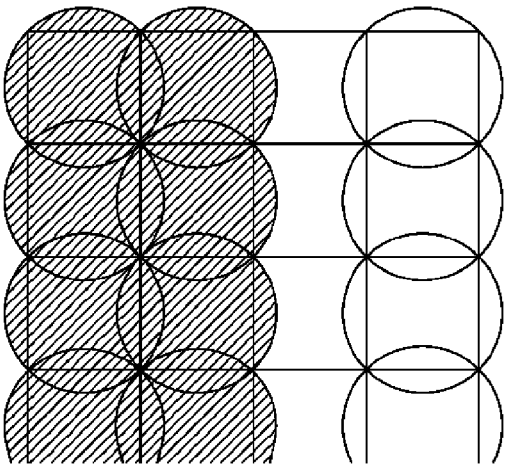
FIG. 7 is an explanatory diagram showing dot forming positions according to an embodiment of the invention.

FIG. 7 is an explanatory diagram showing dot forming positions according to this embodiment. Also in FIG. 7 (and FIG. 8 to be described later), squared boxes represent pixels on a medium. In addition, circles represent dots, a hatching dot represents a color dot, and a non-hatching dot represents a clear dot.

In this embodiment, in order to respond to Problem 3 of the above-described second comparative example, when a dot is formed, a clear dot is formed so as not to be in contact with a color dot. For example, as shown in FIG. 7, a clear dot is not formed in a pixel adjacent to a pixel forming a color dot.

In addition, after a dot is formed, the diameter of the dot expands. However, in this embodiment, a color dot and a clear dot are not in contact with each other even before the provisional curing process. Accordingly, while gloss is maintained to be uniform, the permeation can be suppressed.

Figure 8:
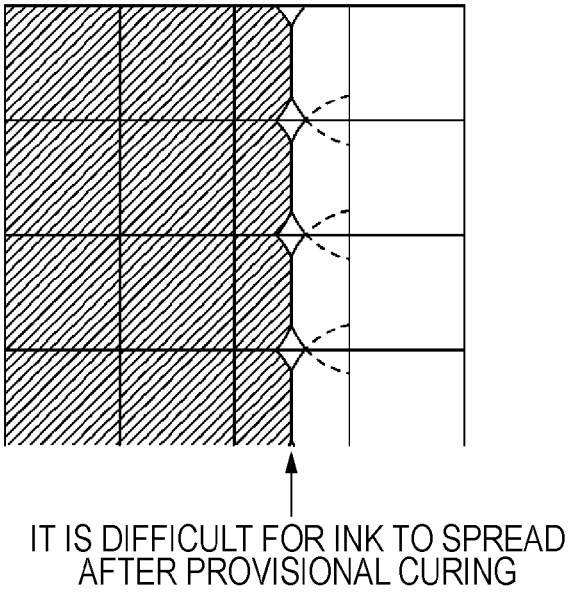
FIG. 8 is an explanatory diagram showing dots at the time of a main curing process according to an embodiment of the invention.

FIG. 8 is an explanatory diagram showing dots at the time of the main curing process according to this embodiment.

Even in a case where a color dot and a clear dot expand so as to be in contact with each other before the main curing process, ink cannot easily permeate after the provisional curing process is performed. In other words, even in a case where a color dot and a clear dot are in contact with each other after the provisional curing process, a problem of permeation as shown in FIG. 6 does not occur. Thus, in this embodiment, the controller 60 adjusts the amount of UV irradiation so as to allow a color dot and a clear dot to be in contact with each other in advance (between a provisional curing process and a main curing process). As described above, when the amount of UV irradiation at the time of the provisional curing process is controlled, it is possible to allow a color dot and a clear dot, which are in the non-contact state before the provisional curing process, to be in the contact state at the time of the main curing process. As a result, the gloss of a printed image can be more uniform.

Third Comparative Example

A third comparative example is a comparative example responding to the above-described Problem 2.

Figure 9:
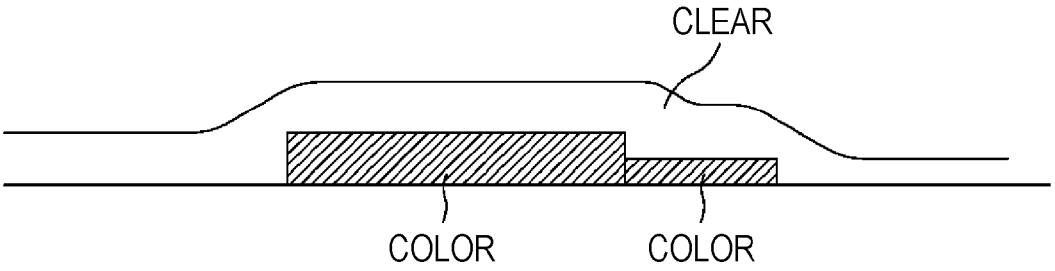
FIG. 9 is an explanatory diagram showing a case where the entire surface of a medium is coated with clear ink after an image is formed.
Figure 10:
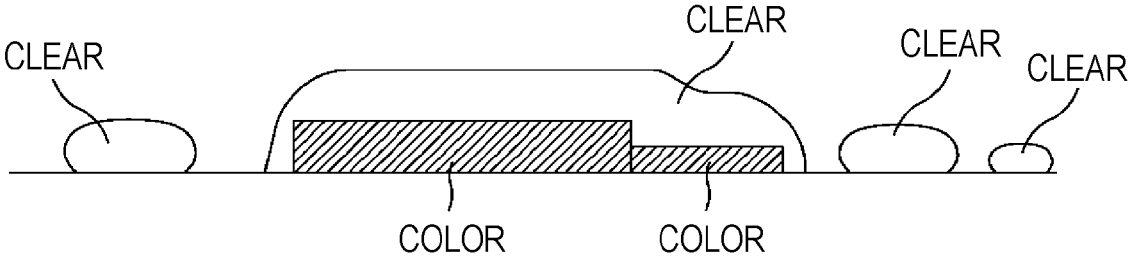
FIG. 10 is an explanatory diagram showing a case where the entire surface of a medium is coated with clear ink after an image is formed.

FIGS. 9 and 10 are explanatory diagrams showing a case where the entire surface of a medium is coated with clear ink after an image is formed.

As shown in FIG. 9, after an image shown in FIG. 5 is formed, the entire surface of the medium is coated with clear ink. As shown in FIG. 9, in a case where the entire surface of a medium is to be coated uniformly, when the medium is directly coated with a large amount of clear ink, ink moves in the horizontal direction (the direction of the surface), whereby aggregation of ink occurs.

Accordingly, in such a case, as shown in FIG. 10, clear ink is aggregated, and uniform gloss cannot be acquired (referred to as Problem 4) in areas other than the image area.

Brief Description 2 of this Embodiment

Figure 11:
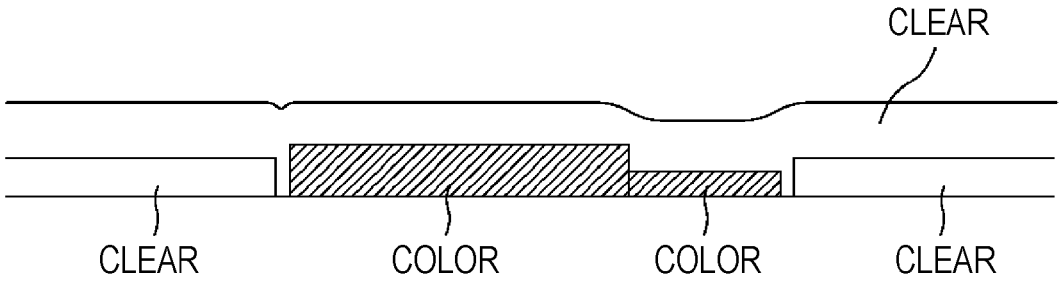
FIG. 11 is a schematic explanatory diagram according to an embodiment of the invention.

FIG. 11 is a schematic explanatory diagram according to this embodiment.

This embodiment responds to Problem 4 of the third comparative example. Accordingly, clear dots are formed in areas (areas other than an image area) in which a color dot is not formed. Thereafter, the color dots and the clear dots are provisionally cured. After the provisional curing process, the entire surface of the medium is coated with ink.

As described above, in this embodiment, the provisionally-cured ink is coated with the clear ink, and accordingly, the aggregation as shown in FIG. 10 cannot easily occur. As described above, by coating the surface with the clear ink, a difference in heights (unevenness) can decrease. As a result, the gloss can be excellent.

Printing Process According to First Embodiment

Figure 12:
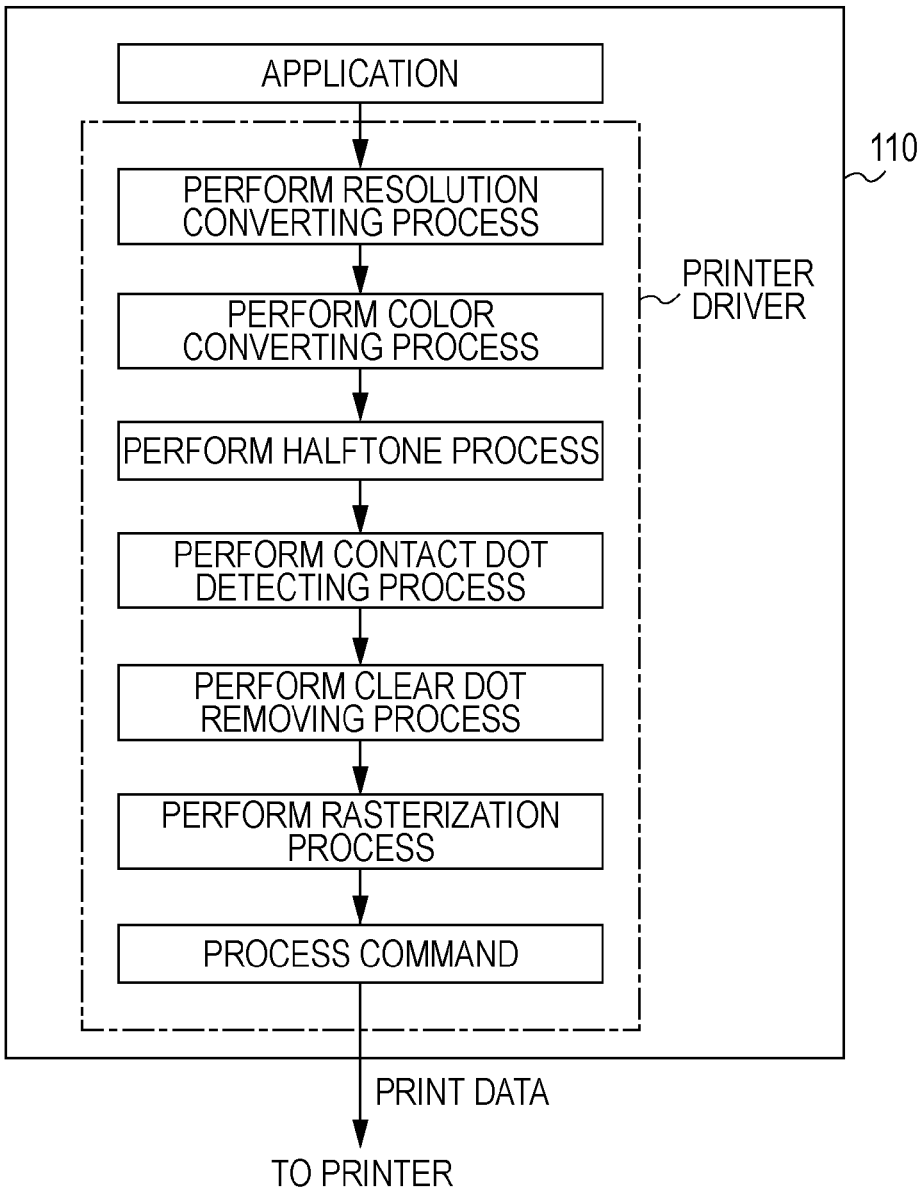
FIG. 12 is a flowchart of a process that is performed by a printer driver.

FIG. 12 is a flowchart of a process that is performed by a printer driver when the printer 1 performs a printing process.

The printer driver receives image data from an application program, converts the image data into print data of a format that can be interpreted by the printer 1, and outputs the print data to the printer. When converting image data output from an application program into print data, the printer driver performs a resolution converting process, a color converting process, a halftone process, a contact-dot detecting process, a clear-dot removing process, a rasterization process, a command adding process, and the like. Hereinafter, various processes performed by the printer driver will be described.

The resolution converting process is a process that converts image data (text data, image data, or the like) output from an application program into data of resolution (print resolution) for paper printing. For example, in a case where the print resolution is designated as 720×720 dpi, the image data of a vector format that is received from the application program is converted into image data of a bitmap format having the resolution of 720×720 dpi. In addition, pixel data of the image data after the resolution converting process is multi-grayscale (for example, 256 gray scales) RGB data represented in an RGB color space.

The color converting process is a process that converts the RGB data into data of a CMYKCl color space that is acquired by adding a Cl plane to a CMYK color space. In addition, the image data of the CMYK image space is data corresponding to the colors of ink included in the printer. The image data of the Cl plane is data that indicates the existence of an image in an area in which an image does not exist as image data of the CMYK plane. In other words, the printer driver generates data representing the existence of an image in an area in which the image does not exist as the image data of the CMYK plane based on the RGB data. In addition, the gray scale value of the image data of the Cl plane is an average gray scale value of image data of the CMYK plane.

The color converting process is performed based on a table (a color conversion lookup table LUT) in which a gray scale value of the RGB data and a gray scale value of the CMYK data are associated with each other. The image data after the color converting process is CMYK data of 256 gray scales that is represented in the CMYK color space.

The halftone process is a process that converts data of which the number of gray scales is high into data of which the number of gray scales, which can be formed by the printer, is low. For example, data representing 256 gray scales is converted into one-bit data representing two gray scales or two-bit data representing four gray scales by performing the halftone process. In the halftone process, a dither method, γ correction, an error diffusion method, or the like is used. The halftone-processed data has the resolution that is equal to that of the print resolution (for example, 720×720 dpi). One-bit pixel data or two-bit pixel data corresponds to the image data after the halftone process for each pixel, and the pixel data is data that represents the state (existence of a dot and the size of a dot) of dot formation in each pixel. In addition, of the image data of the CMYKCl color space after the halftone process, the image data of the Cl plane is data that represents the state of clear dot formation in each pixel.

The contact-dot detecting process is a process that detects a clear dot in contact with a color dot by using the image data of the Cl plane. Hereinafter, a technique thereof will be described.

First, the printer driver determines the sizes of color dots of each color. In this embodiment, the sizes of the dots of each color are different from one another. The reason for the differences in the sizes is that a time interval from dot formation to provisional curing is different for each color. For example, in the case shown in FIG. 2, a time interval from formation of a dot by using the black head K and to provisional curing by using the provisional-curing irradiation section 42 is longer than a time interval from formation of a dot by using the yellow head Y and to provisional curing by using the provisional-curing irradiation section 42. In other words, in a case where a same amount of ink is ejected, the expansion time of the black ink is longer than that of the yellow ink so as to increase the size of the dot.

Next, the printer driver determines the size of a clear dot. The size of a clear dot is determined to be the same as that of a color dot based on the time interval from dot formation to provisional curing.

In addition, the printer driver detects the position of a clear dot that is adjacent to a color dot.

Then, the printer driver calculates a distance between the detected clear dot and a color dot adjacent thereto and determines contact or non-contact based on the calculated distance and the sizes of the color dot and the clear dot.

The clear dot removing process is a process removing a clear dot that is in contact with a color dot. In this clear dot removing process, image data of the Cl plane is corrected such that a clear dot that is in contact with a color dot is not formed. In particular, pixel data representing formation of a clear dot is replaced with pixel data representing no formation of a clear dot.

The rasterization process sorts pixel data aligned in a matrix shape in the order to be transmitted to the printer 1. For example, the pixel data is sorted in accordance with the alignment order of nozzles of each nozzle row.

The command adding process is a process that adds command data corresponding to a print mode to the rasterized data. As the command data, for example, there is transport data that represents the transport speed of a medium or the like.

The print data generated through the above-described process is transmitted to the printer 1 by the printer driver.

Figure 13:
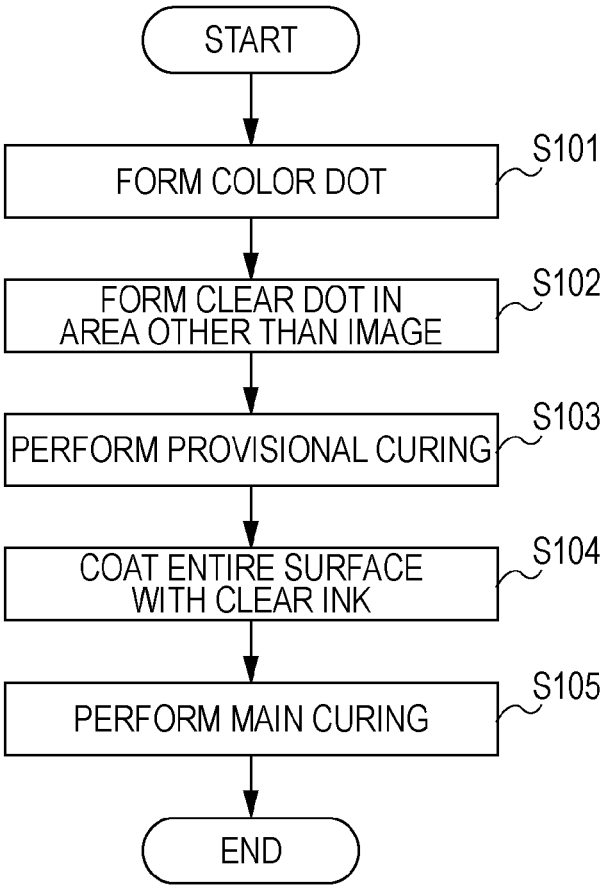
FIG. 13 is a flowchart of a printing process performed by a printer according an embodiment of the invention.

FIG. 13 is a flowchart of a printing process performed by the printer 1 according to this embodiment.

First, the controller 60 ejects color ink from each head of the heads for color ink in the middle of the transport process of a medium based on the print data, whereby forming color dots in an image forming area (S101). Accordingly, an image constituted by the color dots is printed.

Next, the controller 60 ejects clear ink in areas in which an image is not formed by using the first head CL1 for clear ink. Accordingly, clear dots are formed in areas other than an image area (S 102). At this moment, a color dot and a clear dot are in the non-contact state (see FIG. 7). The reason is that the above-described contact dot detecting process and the clear dot removing process are performed when the print data is generated by the printer driver, whereby a clear dot that is in contact with a color dot is removed. As described above, according to this embodiment of the invention, the color ink and the clear ink are not brought into contact with each other when dots are formed, whereby permeation in an image as shown in FIG. 6 does not occur.

Next, the controller 60 allows the provisional-curing irradiation section 42 to emit UV, whereby provisional curing of the color dots and the clear dots is performed (S 103). Also when the provisional curing is performed, a color dot and a clear dot are not in contact with each other. The reason is that, when a clear dot that is in contact with a color dot is detected in the contact dot detecting process of the printer driver, the sizes of dots at the time of the provisional curing process are considered. By performing the provisional curing process, permeation between dots is suppressed. In addition, the diameter of the dot expands after the provisional curing process, and accordingly, excellent gloss can be acquired. The controller 60 controls the amount of UV irradiation for the provisional curing process such that a color dot and a clear dot are in the contact state as shown in FIG. 8 when the main curing process is performed.

Then, after the provisional curing process is performed, the controller 60 coats the entire surface of the medium with clear ink by using the second head CL2 for clear ink (S104). As described above, the number of nozzles of the second head CL2 for clear ink is greater than those of other heads. Accordingly, even when there is unevenness of the surface of a medium more or less before coating, the surface becomes uniform. In addition, since the color dot (and the clear dot) that has been provisionally cured is coated with clear ink, the problem of permeation of ink does not occur.

In addition, the clear dots that have been provisionally cured serve as wedges, and accordingly, it is difficult for the clear ink as a coating of the entire surface to move horizontally (the direction of the surface). Thus, the clear ink cannot easily aggregate unlike FIG. 10. As described above, by coating the entire surface with clear ink, differences in heights of dots can be decreased. Accordingly, the gloss becomes excellent. In addition, the clear ink does not aggregate unlike FIG. 10, whereby the gloss can be more uniform.

Thereafter, the controller 60 allows the main-curing irradiation section 44 to emit UV, whereby a main-curing process is performed (S 105). In the main curing process, UV is emitted onto the clear ink with which the entire surface of the medium is coated. By performing the main curing process, each dot is completely solidified. When the main curing process is performed, a color dot and a clear dot are in the contact state as shown in FIG. 8. The reason is that the controller 60 controls the amount of UV irradiation of the provisional-curing irradiation section 42 such that a color dot and a clear dot are in contact with each other at the time of the main curing process.

Then, after the main curing process is performed, the medium is discharged.

Summary of First Embodiment

In the first embodiment, an image constituted by color dots is printed by ejecting color ink from heads for color ink, and clear dots are formed in areas other than an image area by ejecting clear ink from the first head CL1 for clear ink. Then, after UV for provisional curing is emitted onto the color dots and the clear dots from the provisional-curing irradiation section 42, the entire surface is coated with clear ink by the second clear head CL2, and UV for main curing is emitted onto the clear ink, with which the entire surface is coated, from the main-curing irradiation section 44. Accordingly, differences in heights (unevenness) can be decreased, and aggregation of the clear ink cannot easily occur. As a result, uniform gloss can be acquired.

In addition, when the clear dots are formed in areas other than the image area, the clear dots are formed so as not to be in contact with the color dots. Then, before the color dots and the clear dots are in contact with each other, UV is emitted onto color dots and the clear dots from the provisional-curing irradiation section 42, whereby a provisional curing process is performed. Accordingly, the degradation of the image quality due to permeation of ink can be suppressed.

In addition, before the color dots and the clear dots are in contact with each other, a provisional-curing process is performed with the amount of irradiation for allowing the diameters of dots to expand by the provisional-curing irradiation section 42. Then, after the color dots and the clear dots are in contact with each other, a main-curing process is performed further by the main-curing irradiation section 44. Accordingly, the dots are solidified after being expanded. Thus, a gap between a color dot and a clear dot is decreased, whereby more uniform gloss can be acquired. In addition, the provisional curing process is performed before the color dots and the clear dots are in contact with each other. Thus, even when the color dots and the clear dots are in contact with each other, the problem of permeation of ink does not occur.

In addition, the areas in which the clear dots are formed are determined by the printer driver in consideration of the size of the color dot and the size of the clear dot at the time of the provisional curing process. Accordingly, dots can be configured not to be in contact with each other when the provisional curing process is performed.

In addition, in the first embodiment, in the order from the upstream side in the transport direction, the heads for color ink, the first head CL1 for clear ink, the provisional-curing irradiation section 42, and the second head CL2 for clear ink, and the main-curing irradiation section 44 are disposed. Accordingly, as a medium is transported in the transport direction, the printing of an image, the forming of clear dots in areas other than an image area, a provisional curing process, the coating of the entire surface with clear ink, and a main curing process can be sequentially performed.

The nozzle pitch of the second head CL2 is smaller than that of the heads for color ink or that of the first head CL1. Accordingly, when the entire surface is coated with the clear ink, dots can be formed with high density. Thus, even when there is unevenness of the surface of a medium more or less, a uniform surface can be acquired.

Second Embodiment

Figure 14:
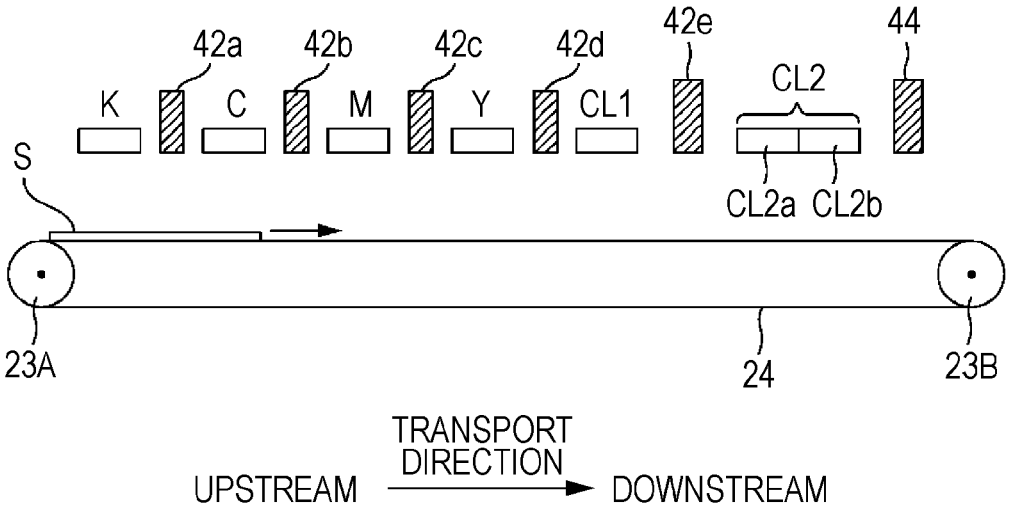
FIG. 14 is a schematic diagram of the periphery of a print area according to a second embodiment of the invention.

FIG. 14 is a schematic diagram of the periphery of a print area according to a second embodiment of the invention. Compared to the first embodiment (FIG. 2), after the heads for color ink (the downstream side in the transport direction), provisional-curing sections are disposed. In FIG. 14, to each unit of a same configuration as that shown in FIG. 2, a same reference sign is assigned, and a description thereof is omitted here.

An irradiation unit 40 according to the second embodiment includes provisional irradiation sections 42*a* to 42*e* and a main-curing irradiation section 44.

The provisional irradiation sections 42*a* to 42*e* are used for UV irradiation for preventing permeation between dots. However, in the provisional curing process, the dots are not completely solidified and continue to spread. The provisional-curing irradiation sections 42*a* to 42*e* are disposed on the downstream sides of a black ink head K, a cyan ink head C, a magenta ink head M, a yellow ink head Y, and a first clear ink head CL1 in the transport direction. In other words, according to the second embodiment, the provisional-curing irradiation section is disposed for each ink color.

In addition, similarly to the first embodiment, the provisional-curing irradiation sections 42*a* to 42*e* include LEDs as light sources for UV irradiation.

In addition, the main-curing irradiation section 44 is the same as that of the first embodiment.

Printing Operation According to Second Embodiment

Next, the printing operation according to the second embodiment will be described.

First, the controller 60 ejects black ink from the black ink head K when a medium passes below the black ink head K. Thereafter, when the medium passes through the provisional irradiation section 42*a*, UV is emitted, whereby provisional curing of a dot formed by the black ink head K is performed. Also for the cyan ink, the magenta ink, and the yellow ink, dot formation and UV irradiation are performed in the same manner.

In the second embodiment, as described above, right after color dots are formed for each color by using color ink, UV is emitted onto each color dot from a corresponding provisional-curing irradiation section.

Then, the controller 60 forms clear dots in areas other than an image area by using the first head CL1 for clear ink. At this moment, similarly to the first embodiment, clear dots are formed such that the clear dots and the color dots are not in contact with each other. Then, before the color dots and the clear dots are in contact with each other, UV is emitted onto each dot from the provisional-curing irradiation section 42*e*.

Thereafter, the entire surface is coated with clear ink by the second head CL2, and UV is emitted onto dots formed on the medium for main curing from the main-curing irradiation section 44.

In the second embodiment, similarly to the first embodiment, dots are formed as shown in FIG. 7 by the first head CL1 for clear ink. In order to implement this, a printer driver according to the second embodiment calculates the size of the dot at the time of provisional curing after formation of clear dots in the above-described "contact dot detecting process". In addition, in the second embodiment, when the size of the color dot at the time of provisional curing after formation of clear dots is calculated, the printer driver considers not the time interval from the dot formation to the provisional curing but the amount of UV irradiation after the formation of color dots in the provisional curing process. For example, as the amount of UV irradiation in the provisional curing process after the formation of color dots increases, the size of the color dot at the time of provisional curing after the formation of clear dots is calculated to be smaller.

According to the second embodiment, the same advantages as those of the first embodiment can be acquired.

In addition, in the second embodiment, since the provisional curing process is performed right after formation of color dots, the speed of expanding the diameters of dots is low. Accordingly, the size of the dot can be calculated in an easy manner.

Summary of Second Embodiment

In the second embodiment, the provisional-curing irradiation sections 42*a* to 42*e* are disposed on the downstream sides of each corresponding head of the heads for color ink and heads for clear ink in the transport direction, and UV irradiation for provisional curing is performed right after formation of color dots of each color and clear dots by the corresponding provisional-curing irradiation sections. Accordingly, the formation of color dots in an image area, UV irradiation for provisional curing, formation of clear dots in areas other than the image area, and UV irradiation for provisional curing are performed. Then, the entire surface is coated with clear ink by the second clear head CL2, and UV irradiation for main curing is performed for the clear ink, with which the entire surface is coated, by the main-curing irradiation section 44. Accordingly, also in the second embodiment, differences in heights (unevenness) can be decreased, and aggregation of the clear ink cannot easily occur. As a result, uniform gloss can be acquired.

In addition, also in the second embodiment, clear dots and clear dots are formed so as not to be in contact with each other. Then, before the color dots and the clear dots are in contact with each other, UV for provisional curing is emitted onto the color dots and the clear dots from the provisional-curing irradiation sections 42*a* to 42*e*, whereby a provisional curing process is performed. Accordingly, the degradation of the image quality due to permeation of ink can be suppressed.

In addition, in the second embodiment, before the color dots and the clear dots are in contact with each other, a provisional-curing process is performed with the amount of irradiation for allowing the diameters of dots to expand by the provisional-curing irradiation sections 42*a* to 42*e*. Then, after the color dots and the clear dots are in contact with each other, a main-curing process is performed further by the main-curing irradiation section 44. Accordingly, the dots are solidified after being expanded. Thus, a gap between a color dot and a clear dot is decreased, whereby more uniform gloss can be acquired. In addition, the provisional curing process is performed before the color dots and the clear dots are in contact with each other. Thus, even when the color dots and the clear dots are in contact with each other, the problem of permeation of ink does not occur.

In addition, also in the second embodiment, the areas in which the clear dots are formed are determined by the printer driver in consideration of the size of the color dot of each color and the size of the clear dot at the time of the provisional curing process. Accordingly, dots can be configured not to be in contact with each other when the provisional curing process is performed.

In addition, also in the second embodiment, the second head CL2 for coating the entire surface with clear ink is disposed in addition to the first head CL1 for clear ink that forms clear dots in areas other than an image area. In addition, the main-curing irradiation section 44 other than the provisional irradiation sections 42*a* to 42*e* is disposed on the downstream side in the transport direction relative to the second head CL2. Accordingly, in the second embodiment, as a medium is transported in the transport direction, the forming and provisional curing of color dots of each color, the forming and provisional curing of clear dots in areas other than an image area, the coating of the entire surface with clear ink, and a main curing process can be sequentially performed.

In addition, in the second embodiment, the nozzle pitch of the second head CL2 is smaller than that of the heads for color ink or that of the first head CL1. Accordingly, when the entire surface is coated with the clear ink, dots can be formed with high density. Thus, even when there is unevenness of the surface of a medium more or less, a uniform surface can be acquired.

Third Embodiment

Figure 15A:
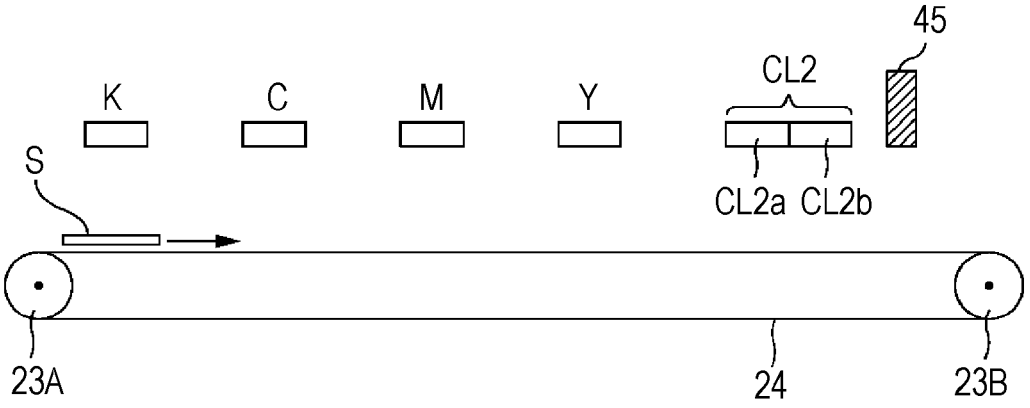
FIGS. 15A and 15C are schematic diagrams of the periphery of a print area and an explanatory diagram of a printing operation according to a third embodiment of the invention.
Figure 15B:
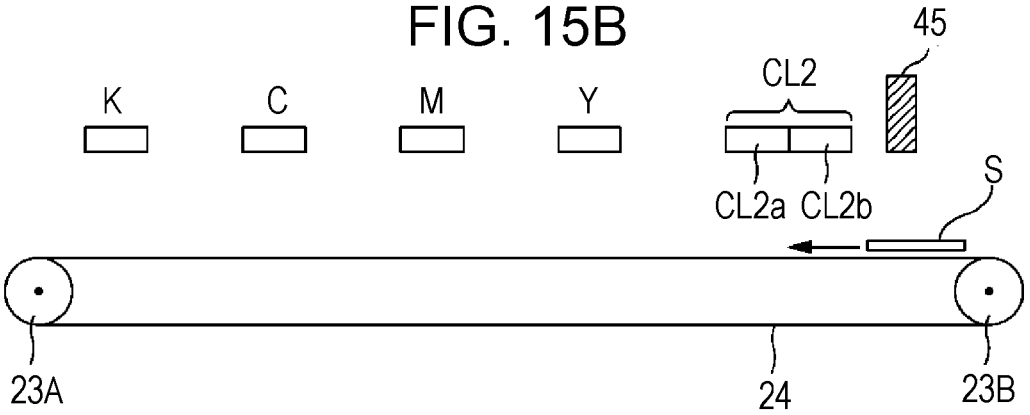
Figure 15C:
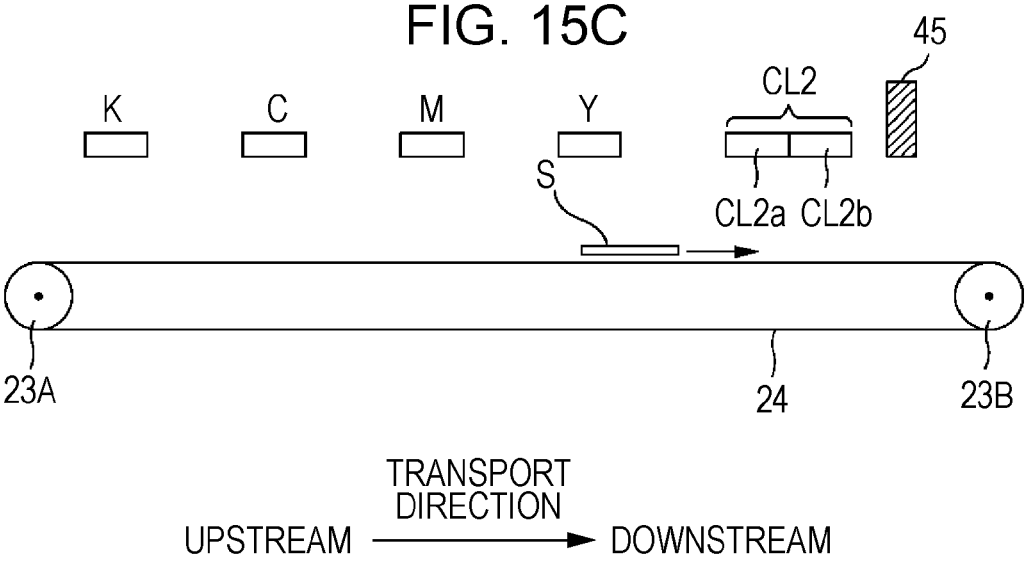

FIGS. 15A and 15C are schematic diagrams of the periphery of a print area and an explanatory diagram of a printing operation according to a third embodiment of the invention. In this figures, to each unit of a same configuration as that shown in FIG. 2, a same reference sign is assigned, and a description thereof is omitted here. In the third embodiment, a head is configured to be commonly used as a head ejecting clear ink in areas other than an image area and a head coating the entire surface with clear ink. In addition, an irradiation section is configured to be commonly used as a provisional curing irradiation section and a main curing irradiation section. In the printer 1 of the third embodiment, a medium can be transported in a reverse direction (reverse transport) that is opposite to the transport direction by reversing the rotation of an upstream transport roller 23A and a downstream transport roller 23B.

Difference Between Third Embodiment and First Embodiment

In the third embodiment, a second head CL2 as shown in FIG. 2 is disposed as a head for clear ink, and an irradiation section 45 that is used for both provisional curing and main curing is disposed as an UV irradiation section.

The second head CL2 is disposed on the downstream side in the transport direction relative to the heads for color ink. In addition, as described above, the second head CL2 includes an upstream head CL2*a* and a downstream head CL2*b*. The arrangement of the above-described heads is as shown in FIG. 3B. One of the upstream head CL2*a* and the downstream head CL2*b*, to be described later, is commonly used in both cases including a case where clear dots are formed in areas, in which an image is not formed, and a case where the entire surface is coated with ink.

The irradiation section 45 is disposed on the downstream side in the transport direction relative to the second head CL2. In addition, the irradiation section 45 includes, for example, LEDs as light sources for UV irradiation. The irradiation section 45, similarly to the above-described embodiment, can change the amount of UV irradiation. In addition, the irradiation section 45 of the third embodiment performs both provisional curing and main curing by changing the amount of irradiation.

Printing Operation According to Third Embodiment

First, as shown in FIG. 15A, the controller 60 transports a medium in the transport direction. Simultaneously, the controller 60 sequentially ejects ink from each head for color ink when the medium passes below the heads for color ink. Accordingly, an image constituted by color dots is printed on the medium.

In addition, when the medium passes below the second head CL2 for clear ink, the controller 60 ejects ink from one of the upstream head CL2*a* and the downstream head CL2*b*, whereby forming clear dots in areas other than an image area. At this moment, similarly to the above-described embodiment, the clear dots are formed so as not to be in contact with the color dots.

In addition, one of the upstream head CL2*a* and the downstream head CL2*b*2 is not used. The reason is that the resolution of the clear dots is the same as the resolution (360 dpi) of the color dots.

Then, when the medium passes below the irradiation section 45, the controller 60 emits UV for provisional curing onto the medium from using the irradiation section 45. In this provisional curing process, similarly to the above-described embodiment, the color dots and the clear dots are not in contact with each other. In addition, the UV for provisional curing is emitted before the color dots and the clear dots are in contact with each other. The amount of UV irradiation for the provisional curing process is controlled by the controller 60 such that a color dot and a clear dot are in the contact state when the main curing process is performed.

After the provisional curing process is performed, as shown in FIG. 15B, the controller 60 transports (reverse transport) the medium in a direction opposite to the transport direction by inverting the rotation of the upstream transport roller 23A and the downstream transport roller 23B. By performing the reverse rotation, the medium is transported to a position (upstream side in the transport direction) before the second head CL2 for clear ink.

Then, as shown in FIG. 15C, the controller 60 transports the medium in the ordinary transport direction by re-inverting the rotation of the upstream transport roller 23A and the downstream transport roller 23B. Then, when the medium passes below the second head CL2, the controller 60 ejects ink from the second head CL2, whereby the entire surface of the medium is coated with clear ink. At this moment, all the nozzles (see FIG. 3B) of two heads of the second heads CL2 for clear ink are used. As described above, in the third embodiment, two heads (the upstream head CL2*a* and the downstream head CL2*b*) can be used for coating the entire surface with clear ink, accordingly, dot formation (coating) for the entire surface of the medium can be performed in a speedy manner. In addition, such a case, since the medium is transported reversely, only coating of the entire surface of the medium located on the belt 24 is performed. Accordingly, in the third embodiment, a high transport speed can be acquired at the time of coating of the entire surface.

Then, when the medium passes below the irradiation section 45, the controller 60 emits UV for main curing onto the medium from the irradiation section 45.

As described above, when the reverse transport is performed, the accuracy of the position of the medium may lowered, whereby an error in the dot forming positions may occur. However, a process for coating the entire surface of the medium with clear ink is performed after the reverse transport. Thus, even when there is an error in the formation positions of clear dots, the image quality is not influenced thereby.

Also in the third embodiment, the advantages same as those of the first embodiment can be acquired.

In addition, in the third embodiment, by performing reverse transport, one head for clear ink and one UV irradiation section can be commonly used. Accordingly, compared to the first embodiment, the number of constituent elements located on the periphery of the head of the printer 1 can be decreased. In addition, as described above, by increasing the transport speed at the time of entire surface coating, a time needed for the entire surface coating can be shortened.

Summary of Third Embodiment

In the third embodiment, an image constituted by color dots is printed by ejecting color ink from heads for color ink, and clear dots are formed in areas other than an image area by ejecting clear ink from one of the upstream head CL2*a* and the downstream head CL2*b* of the second head CL2 for clear ink. Then, after emitting the UV for provisional curing onto the color dots and the clear dots from the irradiation section 45, the medium is reversely transported. Thereafter, the entire surface is coated with clear ink by using both the upstream head CL2*a* and the downstream head CL2*b* of the second head CL2, and the UV for main curing is emitted onto the clear ink, with which the entire surface is coated, from the irradiation section 45. Accordingly, also in the third embodiment, similarly to the above described embodiment, differences in heights (unevenness) can be decreased, and aggregation of the clear ink cannot easily occur.

In addition, in the third embodiment, clear dots are formed so as not to be in contact with the color dots when the clear dots are formed in areas other than the image area. Then, before the color dots and the clear dots are in contact with each other, the UV for provisional curing is emitted onto the color dots and the clear dots from the irradiation section 45. Accordingly, the degradation of the image quality due to permeation of ink can be suppressed.

In addition, in the third embodiment, before the color dots and the clear dots are in contact with each other, a provisional-curing process is performed with the amount of irradiation for allowing the diameters of dots to expand by the irradiation section 45. Then, after the color dots and the clear dots are in contact with each other by reversely transporting the medium, a main-curing process is performed further by the irradiation section 45. Accordingly, the dots are solidified after being expanded. Thus, a gap between a color dot and a clear dot is decreased, whereby more uniform gloss can be acquired. In addition, the provisional curing process is performed before the color dots and the clear dots are in contact with each other. Thus, even when the color dots and the clear dots are in contact with each other, the problem of permeation of ink does not occur.

In addition, also in the third embodiment, the areas in which the clear dots are formed are determined by the printer driver in consideration of the size of the color dot and the size of the clear dot at the time of the provisional curing process. Accordingly, dots can be configured not to be in contact with each other when the provisional curing process is performed.

In addition, in the third embodiment, by reversely transporting the medium, the second head CL2 as one head for clear ink and the irradiation section 45 as one UV irradiation section can be commonly used. Accordingly, compared to the first embodiment, the number of constituent elements located on the periphery of the head of the printer 1 can be decreased. In addition, by using both the upstream head CL2*a* and the downstream head CL2*b* of the second head CL2 for coating the entire surface, the entire surface can be coated with the clear ink in a speedy manner. Accordingly, by increasing the transport speed at the time of entire surface coating, a time needed for the entire surface coating can be shortened.

Fourth Embodiment

The above-described embodiments are implemented as line printers. However, in the fourth embodiment, the same process is performed for a printer (serial printer) that alternately performs a transport operation of transporting a medium in the transport direction and a dot forming operation of ejecting ink from a head while moving the head in a direction (moving direction) intersecting the transport direction. In addition, in the serial printer according to the fourth embodiment, as will be described later, a plurality of nozzle rows of color ink that ejects clear ink on both sides (outer sides) of the nozzle rows are disposed. In addition, the serial printer of the fourth embodiment, as will be described later, can perform reverse transport.

Figure 16:
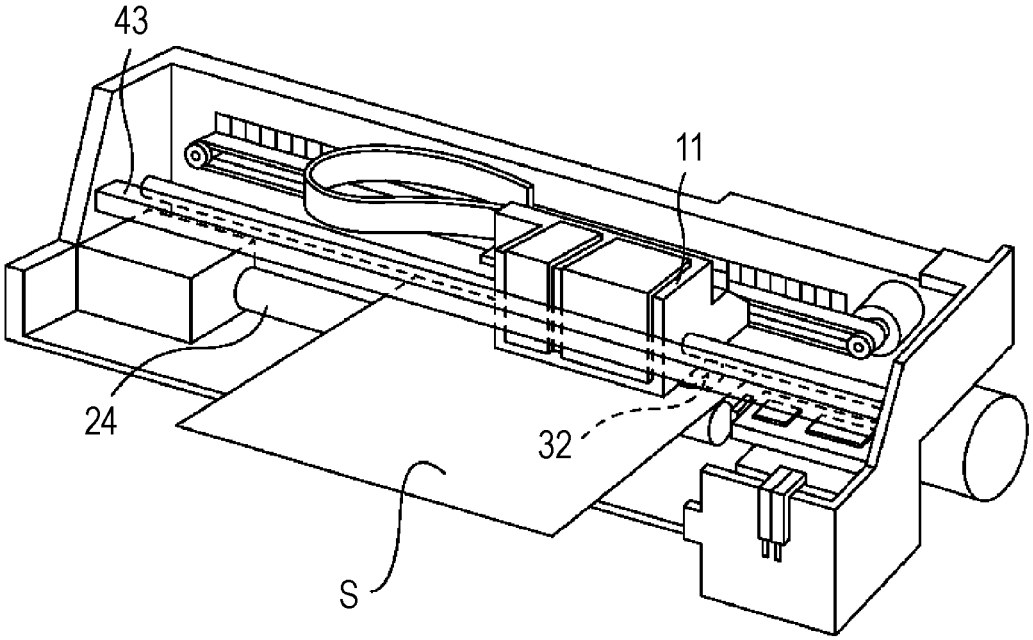
FIG. 16 is a perspective view of a serial printer according to a fourth embodiment of the invention.
Figure 16:
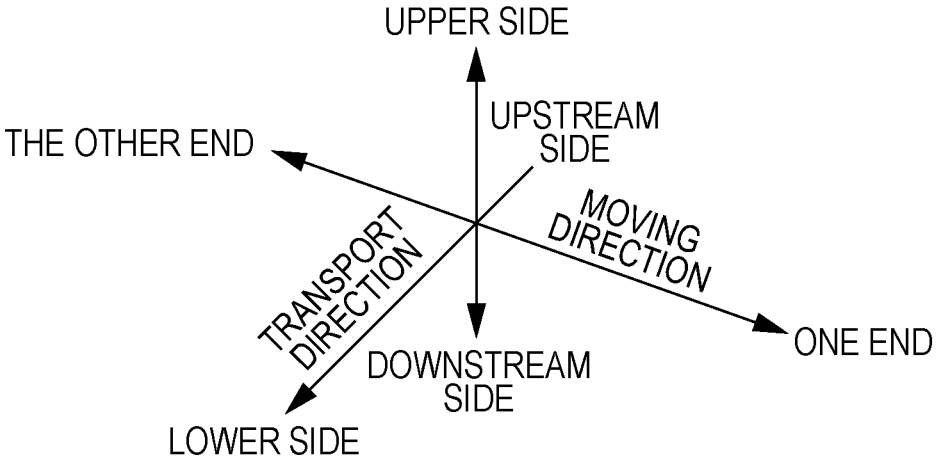

FIG. 16 is a perspective view of a serial printer according to the fourth embodiment.

The serial printer shown in FIG. 16 includes a carriage 11, a head 32, and a provisional-curing irradiation unit 43.

The carriage 11 is used for moving the head 32 in the moving direction. The carriage 11 holds a cartridge, which houses UV ink, so as to be detachably attached thereto. In addition, the carriage 11 is reciprocated in the moving direction along a guide shaft by a carriage motor (not shown).

The head 32 is installed to the carriage 11. While the head 32 moves in the moving direction in accordance with the movement of the carriage 11, UV ink is ejected from each nozzle of the head. The head 32 will be described in detail later.

The provisional-curing irradiation unit 43 is disposed on the downstream side in the transport direction relative to a print area (that is, the head 32) and extends to have a length equal to or more than the medium width. In addition, the provisional-curing irradiation unit 43 has LEDs as light sources for UV irradiation.

Configuration of Head according to Fourth Embodiment

Figure 17:
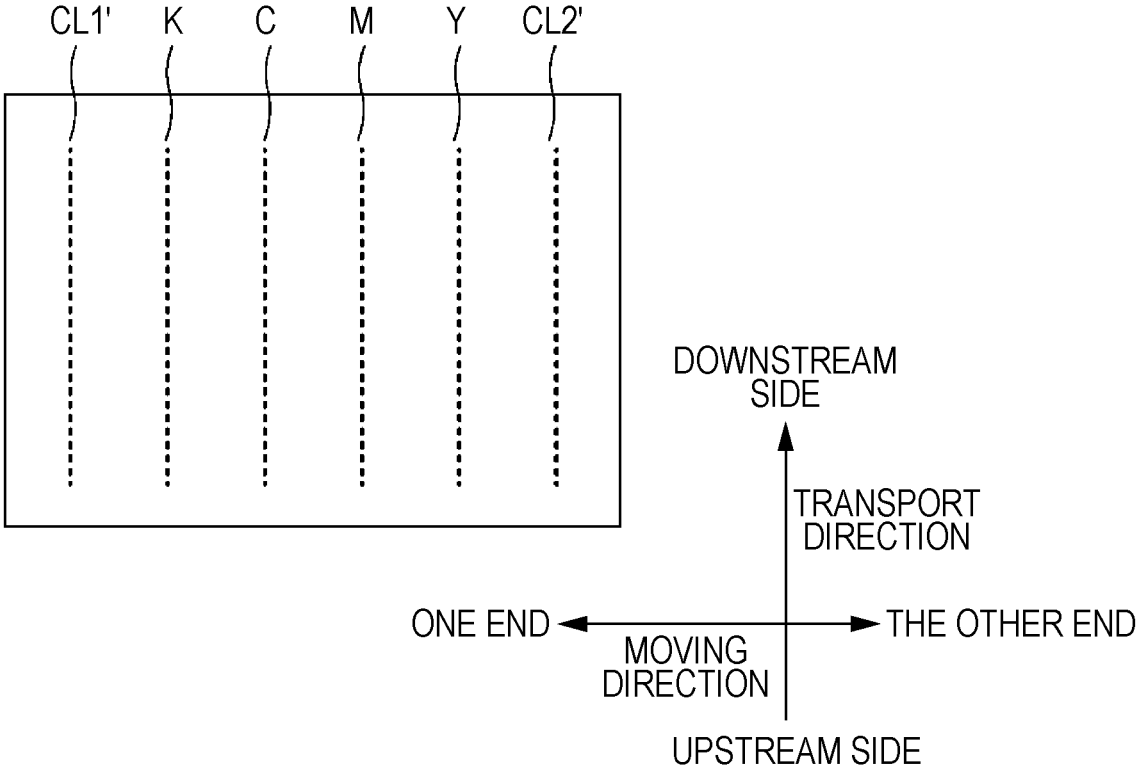
FIG. 17 is an explanatory diagram showing the configuration of a head according to a fourth embodiment of the invention.

FIG. 17 is an explanatory diagram showing the configuration of the head 32 according to the fourth embodiment. To the lower side of the head 32, as nozzle rows for color ink, as shown in FIG. 17, a black ink nozzle row K, a cyan ink nozzle row C, a magenta ink nozzle row M, and a yellow ink nozzle row Y are formed to be sequentially aligned from one end side of the moving direction to the other end side.

In addition, on both sides of the nozzle rows for color ink, nozzle rows for clear ink are disposed. In particular, on one end side in the moving direction relative to the black ink nozzle row K, a first clear-ink nozzle row CL1' is disposed. In addition, on the other end side in the moving direction relative to the yellow ink nozzle row Y, a second clear-ink nozzle row CL2' is disposed. In each nozzle row, a plurality of (for example, 180) nozzles that eject UV ink is disposed with a predetermined nozzle pitch.

Printing Operation of Fourth Embodiment

Next, the printing operation of the fourth embodiment will be described. The operations described below are performed by a controller of the fourth embodiment.

First, in a dot forming operation, UV ink is ejected from color ink nozzles of the head 32 while the carriage 11 moves from one end in the moving direction to the other end (hereinafter, also referred to as a forward path), whereby an image constituted by color dots is printed on a medium.

In addition, in the dot forming operation performed along the forward path, clear ink is ejected from the first clear-ink nozzle row CL1' that is the upstream side in the movement of the head 32, whereby clear dots are formed in areas other than an image area. Here, similarly to the above-described embodiment, the clear dots are formed so as not to be in contact with color dots.

Thereafter, the medium is transported in the transport direction by a predetermined amount (transport operation.

Then, in the next dot forming operation, UV ink is ejected from the color ink nozzles of the head 32 while moving the carriage 11 from the other end in the moving direction to the one end (hereinafter, also referred to as a return path). Accordingly, an image constituted by color dots is printed on the medium.

In addition, in the dot forming operation performed along the return path, clear ink is ejected from the second clear-ink nozzle row CL2', which becomes the upstream side in the movement of the head 32, among the nozzle rows for clear ink, whereby clear dots are formed in areas other than the image area. Also at this moment, the clear dots are formed so as not to be in contact with color dots.

As described above, the nozzle row that is used for forming the clear dots is changed between the forward path and the return path.

Thereafter, the transport operation and the dot forming operation are repeatedly performed. Then, when the medium is transported to a position below the provisional-curing irradiation unit 43, the UV for provisional curing is emitted from the provisional-curing irradiation unit 43. Also in such a case, similarly to the above-described embodiment, the color dots and the clear dots are in the non-contact state. In other words, the UV for provisional curing is emitted before the color dots and the clear dots are in contact with each other. Here, the amount of irradiation for provisional curing is adjusted such that the color dots and the clear dots are in contact with each other before main curing.

Thereafter, the medium is reversely transported to the upstream side in the transport direction. By performing this reverse transport, the medium is transported up to a position located on the upstream side in the transport direction relative to the print area (that is, the head 32). Then, the transport operation for transporting the medium again in the transport direction and the dot forming operation are repeatedly performed. The dot forming operation performed at this moment is to coat the entire surface of the medium with clear ink. Thus, nozzle rows for color ink are not used, and the two nozzle rows for clear ink disposed on both ends are used. In other words, both the nozzle rows for clear ink are used for the dot forming operations performed in the forward path and the return path. As described above, since the two nozzle rows can be used, it is possible to shorten a time needed for the dot forming operation.

Thereafter, before the medium is discharged, UV irradiation for main curing is performed by the main-curing irradiation unit (not shown) for the medium. As in the third embodiment, the provisional curing irradiation unit 43 may be configured to be commonly used both UV irradiation for provisional curing and main curing.

As described above, also in the fourth embodiment, the formation of clear ink and the UV irradiation as in the first embodiment can be performed. Accordingly, the advantages that are the same as those of the first embodiment can be acquired.

Summary of Fourth Embodiment

In the fourth embodiment, by using a printer that repeatedly performs a dot forming operation and a transport operation, in the dot forming operation, an image constituted by color dots is printed by ejecting color ink from color ink nozzles of the head 32, and clear dots are formed in areas other than an image area by ejecting clear ink from one of clear-ink nozzles CL1' and CL2'. Then, after the UV for provisional curing is emitted onto the color dots and the clear dots from the provisional irradiation section 43, the medium is reversely transported. Thereafter, the entire surface is coated with clear ink by using the clear-ink nozzles CL1' and CL2' of the head 32, and the UV for main curing is emitted onto the clear ink with which the entire surface is coated. Accordingly, also according to the fourth embodiment, similarly to the above-described embodiment, differences in heights (unevenness) can be decreased, and aggregation of the clear ink cannot easily occur.

In addition, in the fourth embodiment, color dots and the clear dots are formed such that the color dots and the clear dots are not in contact with each other. Then, before the color dots and the clear dots are in contact with each other, the UV for provisional curing is emitted onto the color dots and the clear dots from the provisional-curing irradiation section 43. Accordingly, the degradation of the image quality due to permeation of ink can be suppressed.

In addition, in the fourth embodiment, before the color dots and the clear dots are in contact with each other, a provisional-curing process is performed with the amount of irradiation for allowing the diameters of dots to expand by the provisional-curing irradiation section 43. Then, after the color dots and the clear dots are in contact with each other, the UV irradiation for a main-curing process is performed. Accordingly, the dots are solidified after being expanded. Thus, a gap between a color dot and a clear dot is decreased, whereby more uniform gloss can be acquired. In addition, the provisional curing process is performed before the color dots and the clear dots are in contact with each other. Thus, even when the color dots and the clear dots are in contact with each other, the problem of permeation of ink does not occur.

In addition, also in the fourth embodiment, the areas in which the clear dots are formed are determined by the printer driver in consideration of the size of the color dot and the size of the clear dot at the time of the provisional curing process. Accordingly, dots can be configured not to be in contact with each other when the provisional curing process is performed.

In addition, in the fourth embodiment, by reversely transporting the medium, the clear ink nozzles CL1' and CL2' can be used for coating the front surface with clear ink. In other words, nozzles can be commonly used as a nozzle for forming the clear dots in areas other than an image area and a nozzle for coating the front surface with clear ink. Accordingly, the number of constituent elements of the head of the printer can be decreased. In addition, both the clear ink nozzles CL1' and CL2' can be used when the front surface is coated with clear ink. Accordingly, by performing the dot forming operation for coating the entire surface in a speedy manner, a time needed for coating the entire surface can be shortened.

Fifth Embodiment

In the above-described embodiment, the clear dots are formed in areas other than an image area by using the clear ink. However, in the fifth embodiment, background dots are formed in areas other than an image area by using ink (white ink in this embodiment) for the background.

Figure 18:
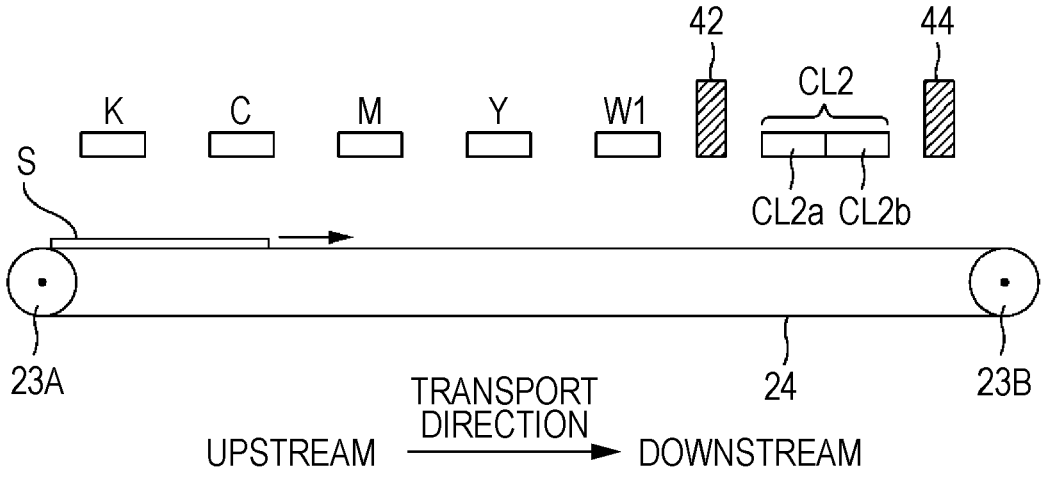
FIG. 18 is a schematic diagram of the periphery of a print area according to a fifth embodiment of the invention.

FIG. 18 is a schematic diagram of the periphery of a print area according to a fifth embodiment of the invention. In FIG. 18, to each unit of a same configuration as that shown in FIG. 2, a same reference sign is assigned, and a description thereof is omitted here.

As shown in FIG. 18, a printer according to the fifth embodiment includes a white ink head W1 for forming white-ink dots, instead of the first head CL1 for clear ink shown in FIG. 2. Also in the fifth embodiment, same as in FIG. 2, the second head CL2 for clear ink is included.

The white ink is used for printing the background of an image. For example, in a case where only texts are printed on a transparent film, the texts cannot be easily seen when there is no background color. As described above, an image cannot be easily seen when only the image is printed on a transparent medium. Thus, in such a case, the background ink such as white ink needs to be used.

Other configurations are almost the same as those of the first embodiment. In addition, the process performed by the printer driver is almost the same as that of the first embodiment. However, in the fifth embodiment, in the process performed by the printer driver, the Cl plane of the first embodiment is a W plane.

In the fifth embodiment, in portions in which clear dots are formed by the first head CL1 according to the first embodiment, white dots (corresponding to background dots) are formed by using white ink.

Figure 19:
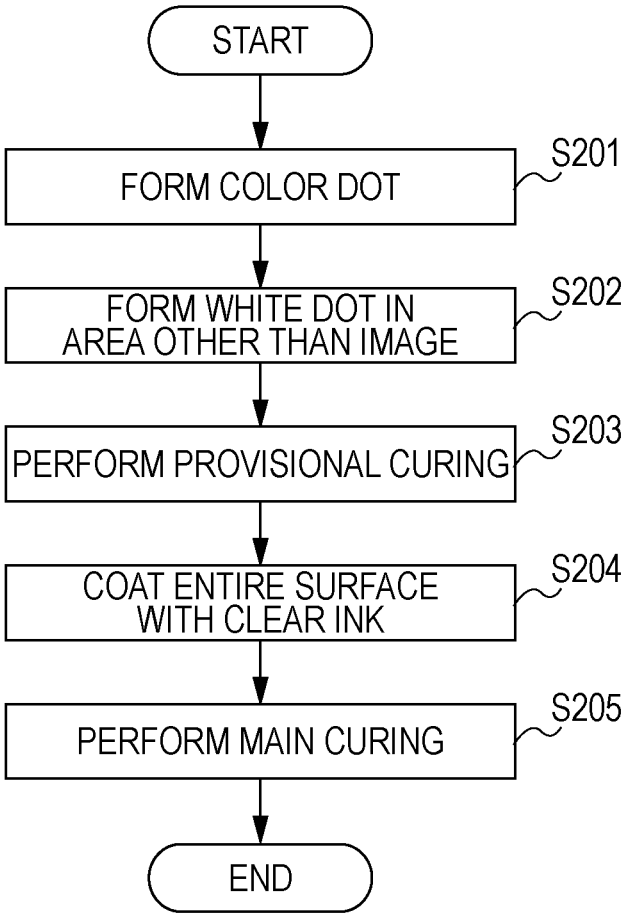
FIG. 19 is a flowchart of a printing process performed by a printer according to the fifth embodiment.

FIG. 19 is a flowchart of a printing process performed by a printer 1 according to the fifth embodiment.

First, the controller 60 ejects color ink from each head of the heads for color ink in accordance with the transport of a medium, whereby forming color dots in an image forming area by using color ink (S201). Accordingly, an image constituted by the color dots is printed.

Next, the controller 60 ejects white ink in areas in which an image is not formed by using a head W1 for white ink. Accordingly, white dots are formed in areas other than an image area (S202). At this moment, a color dot and a white dot are in the non-contact state (see FIG. 7). The reason is that the above-described contact dot detecting process and the white dot removing process are performed when the print data is generated by the printer driver, whereby a white dot that is in contact with a color dot is removed. As described above, according to this embodiment, the color ink and the white ink are not brought into contact with each other when the dots are formed, whereby permeation in an image as shown in FIG. 6 does not occur.

Next, the controller 60 allows the provisional-curing irradiation section 42 to emit UV, whereby provisional curing of the color dots and the white dots is performed (S203). Also when the UV irradiation of the provisional curing is performed, a color dot and a white dot are not in contact with each other. The reason is that, when a white dot that is in contact with a color dot is detected in the contact dot detecting process of the printer driver, the sizes of dots at the time of the provisional curing process are considered. By performing the provisional curing process, permeation between dots is suppressed. In addition, the diameter of the dot expands after the provisional curing process, and accordingly, excellent gloss can be acquired. The controller 60 controls the amount of UV irradiation for the provisional curing process such that a color dot and a white dot are in the contact state as shown in FIG. 8 when the main curing process is performed.

Then, after the provisional curing process is performed, the controller 60 coats the entire surface of the medium with clear ink by using the second head CL2 for clear ink (S204). As described above, the number of nozzles of the second head CL2 for clear ink is greater than those of other heads. Accordingly, even when there is unevenness of the surface of a medium more or less before coating, the surface becomes uniform. In addition, since the color dot (and the white dot) that has been provisionally cured is coated with clear ink, the problem of permeation of ink does not occur.

In addition, the clear dots that have been provisionally cured serve as wedges, and accordingly, it is difficult for the clear ink as a coating of the entire surface to move horizontally. Thus, the clear ink cannot easily aggregate unlike FIG. 10. As described above, by coating the entire surface with clear ink, differences in heights of dots can be decreased. Accordingly, the gloss becomes excellent. In addition, the clear ink does not aggregate unlike FIG. 10, whereby the gloss can be more uniform.

Thereafter, the controller 60 allows the main-curing irradiation section 44 to emit UV, whereby a main-curing process is performed (S205). In the main curing process, UV is emitted onto the clear ink with which the entire surface of the medium is coated. By performing the main curing process, each dot is completely solidified. When the main curing process is performed, a color dot and a white dot are in the contact state as shown in FIG. 8. The reason is that the controller 60 controls the amount of UV irradiation of the provisional-curing irradiation section 42 such that a color dot and a white dot are in contact with each other at the time of the main curing process.

Then, after the main curing process is performed, the medium is discharged.

Difference Between Printing Process of Fifth Embodiment and Trapping Process

The trapping process is a process for a printing target image as a printing target and a background image in which the printing target image is slightly expanded so as to overlap the background image in a case where the printing target image part is printed so as to overlap, for example, a solid color background image.

When the trapping process is not performed, for example, when an overlapping position is slightly deviated due to expansion or contraction of a medium or the like, a portion (for example, an unpatterned portion) that is neither the printing target image nor the background image is seen on a boundary between the printing target image and the background image. In such a case, a finished image may be seen rough. On the other, in a case where the trapping process is performed, even when the overlapping position is slightly deviated, such a problem does not occur.

However, when a trapping process is performed in the configuration of this embodiment, the color dots constituting the printing target image and the background dots (white dots) constituting the background image overlap with each other. Accordingly, permeation between the color dots and the white dots occurs.

On the other hand, in this embodiment, the trapping process is not performed, and the color dots and the white dots are not in contact with each other, whereby permeation between the color dots and the white dots does not occur. Although the trapping process is not performed in this embodiment, the above-described problem of appearance of a portion that is neither the printing target image nor the background image on the boundary between the printing target image and the background image cannot easily occur. The reason is that, as shown in FIG. 8, the diameters of the color dots and the white dots (background dots) expand before the main curing process.

As described above, in the fifth embodiment, by forming the color dots by using the heads for color ink, an image constituted by the color dots is printed on a medium, and the white dots are formed in areas other than the image area so as not to be in contact with the color dots by using the head W1 for white ink. Then, UV is emitted onto the color dots and the white dots from the provisional irradiation section 42 before the color dots and the white dots are in contact with each other. Therefore, the degradation of the image quality due to permeation of ink can be suppressed while uniform gloss is acquired.

In the fifth embodiment, before the color dots and the white dots are in contact with each other, provisional curing is performed with the amount of irradiation allowing the diameters of the dots to expand by the provisional-curing irradiation section 42. Then, after the color dots and the white dots are in contact with each other, the main curing process is performed by the main-curing irradiation section 44. Accordingly, dots can be expanded while preventing permeation between the dots, whereby more uniform gloss can be acquired.

Summary of Fifth Embodiment

In the fifth embodiment, an image constituted by color dots is printed by ejecting color ink from heads for color ink, and white dots for the background are formed in areas other than an image area by ejecting white ink from the head W1 for white ink. Then, after the UV for provisional curing is emitted onto the color dots and the white dots from the provisional irradiation section 42, the entire surface is coated with clear ink by the second clear head CL2, and the UV for main curing is emitted onto the clear ink with which the entire surface is coated from the main-curing irradiation section 44. Accordingly, differences in heights (unevenness) can be decreased, and aggregation of the clear ink cannot easily occur. As a result, uniform gloss can be acquired.

Other Embodiments

The printers and the like have been described as embodiments of the invention. However, the embodiments are not for limiting the scope of the invention but for easy understanding of the invention. Thus, it is apparent that the invention may be changed or modified without departing from the concept of the invention, and equivalents thereof also belong to the scope of the invention. In particular, embodiments described below also belong to the scope of the invention.

Printer

In the above-described embodiments, printers have been described as an example of an apparatus. However, the invention is not limited thereto. For example, technology that is the same as disclosed in the embodiments may be applied to various printing apparatuses that apply ink jet technology such as a color filter manufacturing apparatus, a coloring apparatus, a fine processing apparatus, a semiconductor manufacturing apparatus, a surface processing apparatus, a three-dimensional molding apparatus, a liquid vaporization apparatus, an organic EL manufacturing apparatus (in particular, a high-molecular EL manufacturing apparatus), a display manufacturing apparatus, a deposition system, and a DNA chip apparatus.

Ink

In the above-described embodiments, ink (UV ink) that is cured by receiving irradiation of ultraviolet rays (UV) is ejected from the nozzles. However, the liquid that is ejected from the nozzles is not limited thereto. Thus, liquid that is cured by receiving an electromagnetic wave (for example, visible light) other than the UV may be configured to be ejected from the nozzles. In such a case, the electromagnetic wave (visible light or the like) for curing the liquid may be configured to be ejected from the provisional-curing irradiation section and the main-curing irradiation section.

Regarding FIG. 7

When the color dots and the clear dots are formed on a medium, the color dots and the clear dots may not be configured to be in the non-contact state, unlike FIG. 7. In such a case, permeation between the color dots and the clear dots may occur. However, when aggregation of ink at the time of coating the front surface with clear ink is suppressed, uniform gloss can be acquired.

Implementing State Shown in FIG. 7

The process for implementing the state shown in FIG. 7 is not limited to the method described in the first embodiment.

For example, the printer driver may be configured to perform color conversion into an ordinary CMYK color space. In addition, image data of the Cl plane may be generated such that areas, in which a dot is not formed based on the image data of the CMYK color space after the halftone process, are determined, and the clear dots are disposed in the areas as shown in FIG. 7.

Printer Driver

The process of the printer driver shown in FIG. 12 may be performed on the printer side. In such a case, the printing apparatus is configured by the printer and the personal computer in which the printer driver is installed.

Clear Ink 1

In the above-described embodiments, colorless transparent ink is used for forming dots other than dots of an image. However, the invention is not limited thereto. For example, a semi-transparent processing solution that enables the surface of a medium to have gloss may be used. In addition, the processing may be performed not for the gloss. Thus, a processing solution that adjusts the texture of the surface of a medium may be used.

Clear Ink 2

In the above-described embodiments, the clear dots are formed after the color dots are formed. However, the invention is not limited thereto. For example, the color dots may be formed after the clear dots are formed. Alternatively, the forming of the clear dots and the forming of the color dots may be performed simultaneously.

White Ink

In the fifth embodiment, white ink is used for forming the background dots. However, the invention is not limited thereto. For example, when a medium is light yellow, ink of a light yellow color that is the same as that of the medium may be used.

State after Provisional Curing

In the above-described embodiments, as shown in FIG. 8, the color dots and the clear dots are brought into contact with each other after provisional curing (before main curing). However, the color dots and the clear dots may not be brought into contact with each other after provisional curing. Even in such a case, an advantage that degradation of the image quality due to permeation of ink is suppressed can be acquired.

What is claimed is:

1. A printing method that is performed by using a first nozzle row ejecting a photo-curable color ink, a second nozzle row ejecting a photo-curable clear ink, a coating unit coating a photo-curable clear ink, and a first irradiation unit and a second irradiation unit that each emit electromagnetic waves for curing photo-curable ink, the printing method comprising:

a first ejecting step that prints an image constituted by color dots on a medium by ejecting the color ink from the first nozzle row so as to form the color dots on the medium;

a second ejecting step that forms clear dots on the medium in areas other than the image by ejecting the clear ink from the second nozzle row;

a first emitting step that emits a first electromagnetic wave from the first irradiation unit onto the color dots and the clear dots;

a coating step that coats the color dots and the clear dots with a clear ink after the first emitting step by using the coating unit; and a second emitting step that emits a second electromagnetic wave from the second irradiation unit onto the clear ink with which the color dots and the clear dots are coated, wherein the color dots and the clear dots are not irradiated by any electromagnetic wave from any irradiation unit of the apparatus before the first emitting step.

2. The printing method according to claim 1, wherein the first ejecting step is performed before the second ejecting step and the clear dots are formed in positions such that the color dots and the clear dots are not in contact with each other between when the clear dots were formed on the medium and when the clear dots receive the first electromagnetic wave emitted from the first irradiation unit.

3. The printing method according to claim 2, wherein the clear dots are formed in positions such that the color dots and the clear dots are in contact with each other before the clear dots receive the second electromagnetic wave emitted from the second irradiation unit.

4. The printing method according to claim 1, wherein the second ejecting step is performed before the first ejecting step and the color dots are formed in positions such that the color dots and the clear dots are not in contact with each other between when the color dots were formed on the medium and when the color dots receive the first electromagnetic wave emitted from the first irradiation unit.

5. The printing method according to claim 4, wherein the color dots are formed in positions such that the color dots and the clear dots are in contact with each other before the color dots receive the second electromagnetic wave emitted from the second irradiation unit.

6. The printing method according to claim 1, wherein the first emitting step is performed before the color dots and the clear dots contact each other.

7. The printing method according to claim 6, wherein the second emitting step is performed after the color dots and the clear dots are in contact with each other.

8. The printing method according to claim 1, wherein the first electromagnetic wave is emitted from the first irradiation unit onto the color dots and the clear dots with an amount of irradiation that allows the diameters of the color dots and the clear dots to expand, and wherein, after the color dots and the clear dots contact each other due to expansion of the diameters of the color dots and the clear dots after irradiation of the first electromagnetic wave from the first irradiation unit, the second electromagnetic wave is emitted onto the color dots and the clear dots from the second irradiation unit.

9. The printing method according to claim 1, wherein the areas other than the image are determined in accordance with one of a time interval from the formation of the color dots to the emitting of the first electromagnetic wave from the first irradiation unit and a time interval from the formation of the clear dots to the emitting of the first electromagnetic wave from the first irradiation unit.

10. The printing method according to claim 1, wherein the coating unit has a third nozzle row, which ejects the clear ink, wherein the first irradiation unit is disposed on the downstream side in the transport direction of the medium relative to the first nozzle row and the second nozzle row, wherein the third nozzle row is disposed on the downstream side in the transport direction relative to the first irradiation unit, and wherein the second irradiation unit is disposed on the downstream side in the transport direction of the medium relative to the third nozzle row.

11. The printing method according to claim 10, wherein the first nozzles are aligned with a predetermined nozzle pitch, and wherein the third nozzles are aligned with a predetermined nozzle pitch that is narrower than the predetermined nozzle pitch of the first nozzles.

12. A printing apparatus comprising:

a first nozzle ejecting photo-curable color ink;

a second nozzle ejecting a photo-curable clear ink;

a coating unit coating a clear ink that is cured by irradiation with an electromagnetic wave;

a first irradiation unit emitting a first electromagnetic wave for curing photo-curable ink;

a second irradiation unit emitting a second electromagnetic wave for curing photo-curable ink; and a controller configured to:

print an image constituted by color dots on the medium by ejecting the color ink from the first nozzle so as to form the color dots on the medium, form clear dots on the medium in areas other than where the image is formed by ejecting the clear ink from the second nozzle;

emit the first electromagnetic wave onto the color dots and the clear dots by using the first irradiation unit;

coat the color dots and the clear dots with the clear ink by using the coating unit; and emit the second electromagnetic wave onto the clear ink, with which the color dots and the clear dots are coated, by using the second irradiation unit, wherein the color dots and the clear dots do not receive any electromagnetic wave from any irradiation unit of the apparatus before the color dots and the clear dots receive the first electromagnetic wave emitted from the first irradiation unit.

* * * * *